US006365314B1

(12) United States Patent
Tomiyama et al.

(10) Patent No.: US 6,365,314 B1
(45) Date of Patent: Apr. 2, 2002

(54) TONER FOR DEVELOPING ELECTROSTATIC IMAGE, IMAGE FORMING METHOD AND PROCESS CARTRIDGE

(75) Inventors: Koichi Tomiyama, Numazu; Takaaki Kohtaki, Mishima; Manabu Ohno, Numazu; Makoto Unno, Tokyo; Yushi Mikuriya, Numazu; Nobuyuki Okubo, Yokohama; Tadashi Doujo, Numazu; Shunji Suzuki, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/457,138

(22) Filed: Dec. 9, 1999

Related U.S. Application Data

(60) Division of application No. 08/862,353, filed on May 23, 1997, now Pat. No. 6,090,515, which is a continuation-in-part of application No. 08/436,823, filed on May 8, 1995, now abandoned.

(30) Foreign Application Priority Data

May 13, 1994 (JP) ..... 6-123303

(51) Int. Cl.[7] ..... G03G 9/097

(52) U.S. Cl. ..... 430/108.23; 430/108.4; 430/124; 399/111

(58) Field of Search ..... 430/110, 106, 430/124, 111, 108.4, 108.23, 110.4; 399/111

(56) References Cited

U.S. PATENT DOCUMENTS

| | | | |
|---|---|---|---|
| 2,221,776 | A | 11/1940 | Carlson |
| 2,297,691 | A | 10/1942 | Carlson |
| 2,618,552 | A | 11/1952 | Wise |
| 2,874,063 | A | 2/1959 | Greig |
| 3,666,363 | A | 5/1972 | Tanaka et al. |
| 3,909,258 | A | 9/1975 | Kotz |
| 4,071,361 | A | 1/1978 | Marushima |
| 4,623,606 | A | 11/1986 | Ciccarelli |
| 4,868,084 | A | 9/1989 | Uchide et al. |
| 4,883,736 | A | 11/1989 | Hoffend |
| 4,939,060 | A | 7/1990 | Tomiyama et al. |
| 5,155,000 | A | 10/1992 | Matsumura et al. |
| 5,180,649 | A | 1/1993 | Kukimoto |
| 5,250,382 | A | 10/1993 | Shimojo |
| 5,268,248 | A | 12/1993 | Tanikawa |
| 5,338,638 | A | 8/1994 | Tsuchiya et al. |
| 5,344,737 | A | 9/1994 | Berkes et al. |
| 5,439,770 | A | 8/1995 | Taya et al. |
| 5,439,773 | A | 8/1995 | Matsui et al. |
| 5,466,555 | A | 11/1995 | Taguchi et al. |

FOREIGN PATENT DOCUMENTS

| | | |
|---|---|---|
| EP | 276147 | 7/1988 |
| EP | 461672 | 12/1991 |
| EP | 592018 | 4/1994 |
| EP | 621513 | 10/1994 |
| JP | 61-155464 | 7/1986 |
| JP | 62-177561 | 8/1987 |
| JP | 1-306862 | 12/1989 |
| JP | 2-153362 | 6/1990 |
| JP | 3-209266 | 9/1991 |

OTHER PUBLICATIONS

Patent Abstracts of Japan, vol. 14, No. 4090 (P–1098) [4343] 1990.

Diamond, Arthur S., Handbook of Imaging Materials, Marcel–Dekker, Inc. (New York) pp. 182–191; 1991.

English Translation of JP 5–165250.

*Primary Examiner*—Christopher Rodee

(74) *Attorney, Agent, or Firm*—Fitzpatrick, Cella, Harper & Scinto

(57) ABSTRACT

A toner for developing electrostatic images. having a uniform composition and uniform performances over varying sizes of toner particles is constituted by (a) a binder resin, (b) a long-chain alkyl compound and (c) a specific azo-type iron complex. The long-chain alkyl compound is represented by the following formula (1), (2) or (3):

$$CH_3\text{-}(CH_2)_x\text{-}CH_2OH \quad (1),$$

$$CH_3\text{-}(CH_2)_x\text{-}O\text{-}(CH(R)CH_2\text{-}O)_z\text{-}H, \quad (2)$$

$$CH_3\text{-}(CH_2)_y\text{-}CH_2COOH \quad (3),$$

wherein x and y independently denote an average value in the range of 35–150.

35 Claims, 4 Drawing Sheets

TONER FOR DEVELOPING ELECTROSTATIC IMAGE, IMAGE FORMING METHOD AND PROCESS CARTRIDGE

This application is a division of Application No. 08/862,353, filed May 23, 1997, now U.S. Pat. No. 6,090,515 which, in turn, is a continuation-in-part of Application No. 08/436,823, filed May 8, 1995, now abandoned, both of which are incorporated herein by reference in their entirety.

FIELD OF THE INVENTION AND RELATED ART

The present invention relates to a toner, particularly a negatively chargeable toner, for developing electrostatic images in image forming methods, such as electrophotography, and electrostatic printing. The present invention also relates to an image forming method and a process cartridge using the toner.

Hitherto, a large number of electro-photographic processes have been known, as disclosed in U.S. Pat. Nos. 2,297,691; 3,666,363; 4,071,361 and others. In these processes, an electric latent image is formed on a photosensitive member comprising a photoconductive material by various means, then the latent image is developed and visualized with a toner, and the resultant toner image is, after being transferred onto a transfer-receiving material, such as paper, as desired, fixed by heating, pressing, heating and pressing, etc., to obtain a copy or a print. In the case of including the step of transferring a toner image, a step of removing residual toner remaining on the photosensitive member is ordinarily also included.

Known developing methods for visualizing electrical latent images with a toner may include, e.g., the magnetic brush method described in U.S. Pat. No. 2,874,063, the cascade developing method disclosed in U.S. Pat. No. 2,618,552, the powder cloud method disclosed U.S. Pat. No. 2,221,776, and a method using an electroconductive magnetic toner disclosed in U.S. Pat. No. 3,909,258.

As for the step of fixing the toner image onto a sheet material such as paper which is the final step in the above process, various methods and apparatus have been developed, of which the most popular one is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under pressure, a very good heat efficiency is attained for melt-fixing the toner image onto the fixation sheet to afford quick fixation.

Recently, in place of hot rollers, there has been commercialized a fixing apparatus comprising a heating member and a pressing member which is disposed opposite to the heating member and presses a recording medium (such as paper) to contact the heating member via a film.

On the other hand, in recent years, there have been also desired high-quality copy or print images in accordance with the use of digitalized copying machines and fine toner particles.

More specifically, it has been desired to obtain a photographic image accompanied by characters, so that the character images are clear while the photographic image is excellent in density gradation faithful to the original. Generally, in a copy of a photographic image accompanied by characters, if the line density is increased so as to provide clear character images, not only the density gradation characteristic of the photograph image is impaired, but also the halftone part thereof is roughened.

Further, resolution failure (collapse) of line images and scattering are liable to be caused at the time of fixation as described above, so that the image qualities of the resultant copy images are rather liable to be deteriorated.

Further, in case where the line image density is increased, because of an increased toner coverage, a thick toner image is pushed against a photosensitive member to be attached to the photosensitive member in the toner transfer step, so that a so-called transfer failure (or a hollow image), i.e., a partial lack toner image (line images in this case), in the transferred image, is liable to be caused, thereby providing poor quality of copy images. On the other hand, in case where the gradation characteristic of a photographic image is intended to be improved, the density of characters or line images is liable to be lowered, thus providing unclear images.

In recent years, there has been obtained some improvement in density gradation characteristic by a system including image density readout and digital conversion. However, a further improvement has been desired.

Regarding density gradation characteristic, it is impossible to obtain a linear relationship between a developing potential (difference between a photosensitive member potential and a developer-carrying member potential) and a resultant (copy) image density. In a halftone region, a slight change in developing potential leads to a remarkable change in image density. This provides a difficulty in obtaining a satisfactory density gradation characteristic.

Generally, copied images appear clearer because of an edge effect of attracting an increased amount of toner so that clear line images can be retained in the case where a maximum density of ca. 1.30 is attained at a solid image part which is less affected by the edge effect.

In case of a photographic image, however, the maximum density of a photograph appears less at a glance because of its surface gloss but actually amounts to a very high image density level of 1.90–2.00. Accordingly, in a copy of a photographic image, even if the surface gloss is suppressed, a solid part image density of ca. 1.4–1.5 is required since a density increase due to the edge effect cannot be expected because of a large image area.

Accordingly, in providing a copy of a photographic image accompanied by characters, it becomes very important to obtain a developing potential-image density relationship which is close to the first order (linear) one and also a maximum image density of 1.4–1.5.

Further, the density gradation characteristic is liable to be remarkably affected by the saturation charge and the charging speed of a developer used. In case where the saturation charge is appropriate for the developing conditions, a developer showing a slow charging speed provides a low maximum image density, thus generally thin and blurred images in the initial stage of copying. In this case, however, satisfactory images can be obtained if the maximum image density is ca. 1.3, as described above, thus being able to obviate an adverse effect of the slow chargeability. Even in case of slow charging speed, the initial copy image density is increased if the saturation charge is increased. However, on continuation of copying, the charge of the developer is gradually increased to finally exceed an appropriate charge for development, thereby resulting in a lower copy image density. Also in this case, no problem occurs in line images if the maximum image density is ca. 1.3.

From the above, it is understood that a photographic image is more remarkably affected by the saturation charge and the charging speed of a developer than a line image.

In case where a smaller particle size toner is used, the dispersion state of a charge control agent and a colorant remarkably affects the chargeability of the toner.

A toner for developing electrostatic images may generally contain a dye called a charge control agent for controlling the chargeability of the toner. In order to provide a toner with a negative chargeability, chromium complex compounds have been principally used.

Japanese Laid-Open Patent Application (JP-A) 60-170864, describes that, among such chromiun complex compounds, those having a good mutual solubility with a binder resin show a uniform negative chargeability and provide clear copy images but are liable to be accompanied with difficulties, such as forming a toner residue on a photosensitive member due to cleaning failure and filming. Those chromium complex compounds being insoluble with a binder resin (particularly in a polyester resin) show good chargeability and also good anti-filming characteristic.

However, a metal complex salt compound insoluble or incompatible with a binder resin shows a poor dispersibility. Accordingly, when a toner containing such a metal complex salt compound is formulated into fine particles, the toner is liable to be charged excessively particularly in a low-humidity environment, thus leading to fog or a reduction in density. This is because a fine particle size fraction and a coarse particle size fraction formed through a pulverization step of toner production are caused to have remarkably different contents (weight ratios) of the charge control agent (i.e.,so-called localization of a charge control agent), so that toner particles are caused to have different chargeabilities.

In case where a fine powder fraction and a coarse powder fraction recovered from the classifying step are re-utilized as a material for toner production, the above-mentioned liability of localization of a charge control agent is further promoted to cause difficulties, such as a lowering in image density and fog due to a toner electrification insufficiency under a low-humidity condition. For this reason, it has been hitherto difficult to reutilize both the fine powder and coarse powder by-produced in the classification step for toner production, and coarse powder alone has been reutilized as proposed in JP-A 3-209266. JP-A 61-155464 and JP-A 62-177561 have proposed an azo-type iron complex as a charge control agent showing good dispersibility within a binder resin. A toner containing the azo-type iron complex is, however, accompanied with difficulties, such as a slow rate of electrification and a lowering in image density after a long period of standing or in a high humidity environment. In recent years, a smaller particle size (at most 9 $\mu$m in terms of a weight-average particle size (diameter)) is recommended for providing high-quality images. A small particle size toner is liable to have a remarkably high charge under a low-humidity condition and cause difficulties, such as thinning of line images, a lowering in image density and occurrence of reversal potential fog caused by a toner charged to an opposite polarity due to charging failure on a developer-carrying member, such as a developing sleeve, due to the copresence of the excessively charged toner.

In order to improve the chargeability of a toner containing such an azo-type iron complex, JP-A 1-306862 has proposed a silicone resin-coated carrier which has a high chargeability-imparting effect, and JP-A 2-153362 has proposed a developing apparatus including an improved toner layer thickness-regulating member and an improved toner replenishment-assisting member. In these proposals, the developing performance of the toner is retained by charge-imparting or -assisting members and it is difficult to retain good image quality for a long period due to deterioration or soiling of the charge-imparting or -assisting member.

SUMMARY OF THE INVENTION

An object of the present invention is to provide a toner for developing electrostatic images having solved the above-mentioned problems and capable of retaining a high-quality image forming performance for a long period.

An object of the present invention is to provide a toner having a good dispersibility of a charge control agent and a uniform chargeability, capable of retaining a high image density for a long period and capable of providing images free from fog and with a high resolution.

Another object of the present invention is to provide a toner which can be quickly charged and can provide good toner images similarly as before standing even after storage for a long period or in a high-humidity environment.

Another object of the present invention is to provide a toner which can provide high-quality images without using a charge-assisting member.

Another object of the present invention is to provide a fine particle size toner which can provide satisfactory developed images for a long period under various environmental conditions even in case of providing high-resolution developed images.

Another object of the present invention is to provide a toner which allows re-utilization of fine powder and coarse powder by-produced in the classification step in toner production.

Another object of the present invention is to provide a toner highly suitably adapted to an electrophotographic process not adversely affecting a photosensitive member or a developer-carrying member.

A further object of the present invention is to provide an image forming method and a process cartridge using such a toner as described above.

According to the present invention, there is provided a toner for developing electrostatic images, comprising:

(a) a binder resin, (b) a long-chain alkyl compound represented by the following formula (1), (2) or (3):

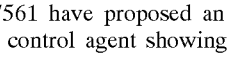

$$CH_3\text{-}(CH_2)_x\text{-}CH_2OH \quad (1),$$

wherein x denotes an average value in the range of 35–150,

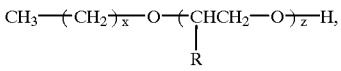

$$CH_3\text{-}(CH_2)_x\text{-}O\text{-}(CHR\text{-}CH_2\text{-}O)_z\text{-}H, \quad (2)$$

wherein x denotes an average value in the range of 35–150; z denotes an average value in the range of 1–5, and R denotes H or an alkyl group having 1–10 carbon atoms,

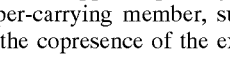

$$CH_3\text{-}(CH_2)_y\text{-}CH_2COOH \quad (3),$$

wherein y denotes an average value in the range of 35–15; and (c) an azo-type iron complex compound represented by the following formula (4);

(4)

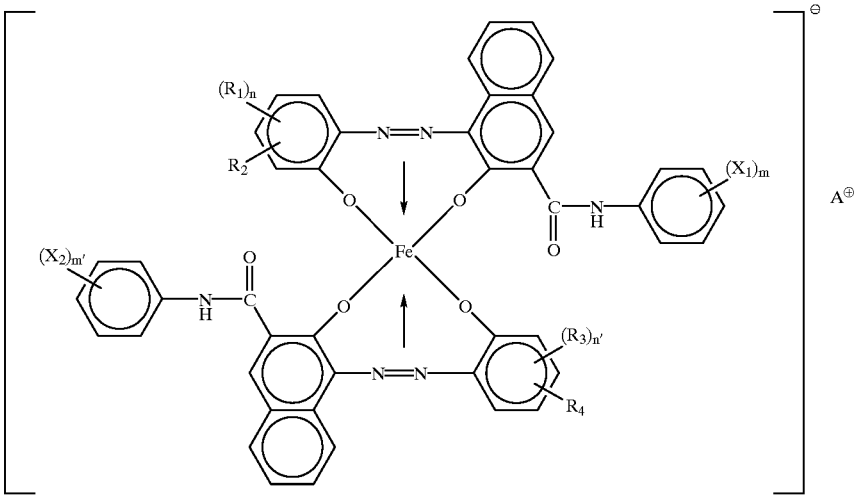

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-8}$ alkyl or alkenyl, sulfonamide, mesyl, sulfonic acid group, carboxy ester group, hydroxy, $C_{1-8}$ alkoxy, acetylamino, benzoylamino or halogen atom; n and n' denote an integer of 1–3; $R_2$ and $R_4$ denote hydrogen atom or nitro group; and $A_+$ denotes a cation including 75–98 mol. % of ammonium ion and another ion selected from the-group consisting of hydrogen ion, sodium ion, potassium iron and mixtures thereof.

According to another aspect of the present invention, there is provided an image forming method, comprising:

a charging step of supplying a voltage to a charging means in contact with a member to charge the member, a step of forming an electrostatic image on the charged member, a developing step of developing the electrostatic image with a toner as described above to form a toner image on the member, a transfer step of transferring the toner image to a transfer-receiving material directly or via an intermediate transfer member, and a fixing step of fixing the toner image onto the transfer-receiving material.

According to a further aspect of the present invention, there is provided a process-cartridge, comprising at least a developing means and a photosensitive member, the developing means and the photosensitive member being integrated into a cartridge which is detachably mountable to a main body of an image forming apparatus, wherein the developing means contains a toner as described above.

DETAILED DESCRIPTION OF THE INVENTION

Figure 1:
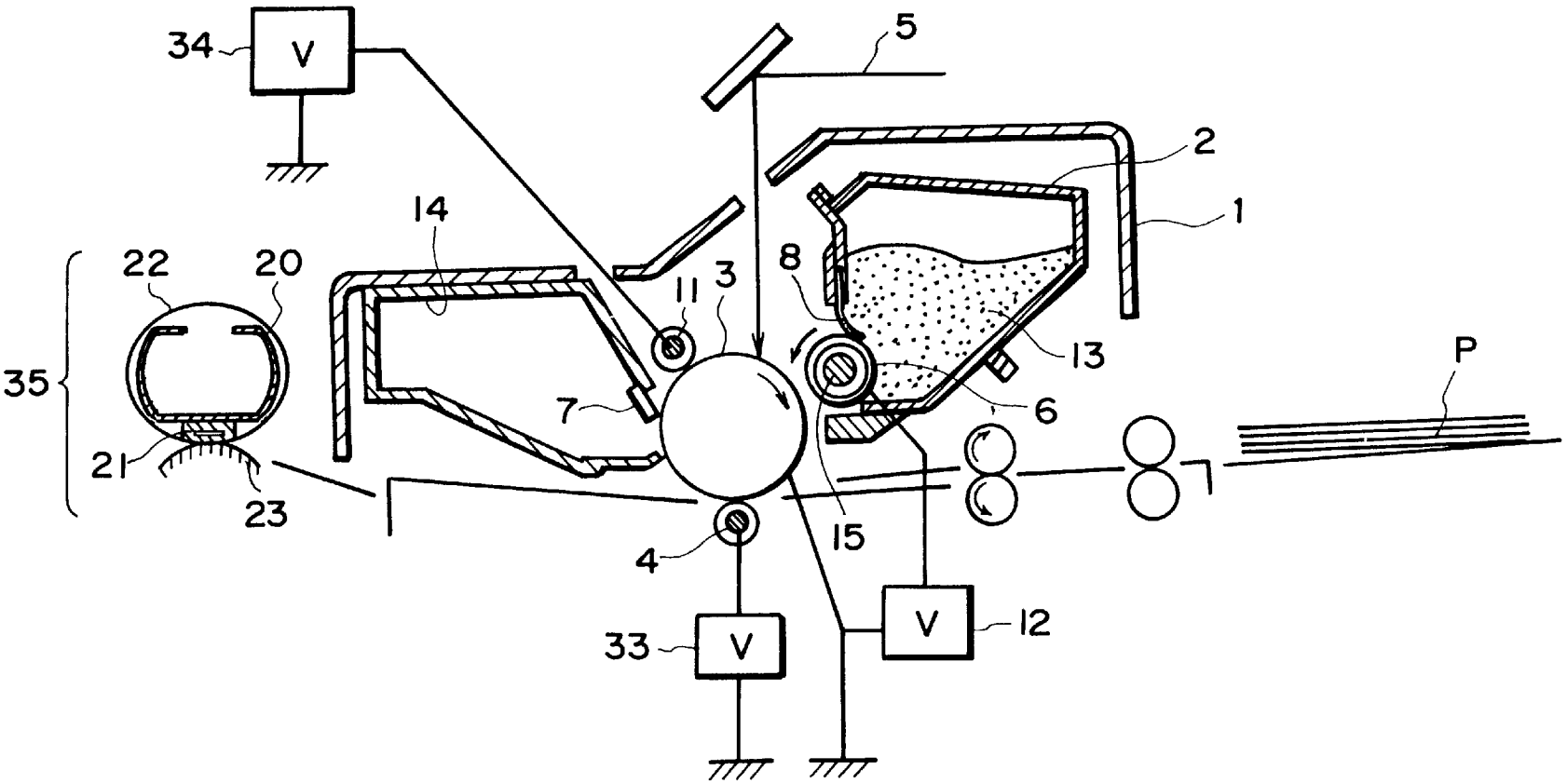
FIG. 1 is a schematic illustration of an image forming apparatus used in Examples of the present invention.

As a result of our study, it has been found possible to provide a toner capable of forming stable images while retaining a high development performance and without being affected by an environmental change.

An azo-type iron complex, when used as a charge control agent for an electrophotographic toner, provides a toner which shows an insufficient charging speed under a high-humidity condition and fails to provide a sufficient image density at an initial stage or a long period of standing under a high-humidity condition. Under a low-humidity condition, in a long period of continual use, the toner is liable to cause an accumulation of an excessive triboelectric charge (charge-up), thus resulting in images with a low image density and noticeable fog.

In contrast thereto, a chromium or aluminum complex compound insoluble in a binder resin alleviates the above-mentioned problems and has been therefore widely used. A toner using such a chromium or aluminum complex compound is accompanied with a problem that classified fine powder and classified coarse powder thereof cannot be readily re-utilized. This is because the chromium or aluminum complex compound is contained in different weight ratios in the classified fine powder, classified medium powder (used as a toner) and classified coarse powder, so that a toner produced by re-utilization of the classified fine powder and the classified coarse powder is liable to cause a lowering in image density and fog during a long period of continual use in a low-humidity environment.

We have noted in combination that an azo-type iron complex compound shows little localization in classified powders and that a binder containing an azo-type chromium complex compound insoluble in a binder resin shows a good developing performance, whereby we have succeeded in improving the charge controllability of an azo-type iron complex compound while retaining the non-localizability of the azo-type iron complex compound, by forming microdomains (aggregations) of the azo-type iron complex compound in toner particles.

The formation of an azo-type iron complex compound is accomplished by the presence of a long-chain alkyl compound in toner particles. This is considered because the OH groups or carboxyl groups in the long-chain alkyl compound respectively form an associated state and, under the influence of the associations, the azo-type iron complex compound forms microdomains. As a result, the azo-type iron complex compound can be provided with an improved charge controllability while maintaining the non-localizability.

The localization of an azo-type metal complex in classified fine powder, classified medium powder (used as a toner) and classified coarse powder resultant after a classification step in a toner production process using the azo-type metal complex is evaluated in the following manner. Each powder fraction is weighed in a prescribed amount within a range of 1.0–3.0 g and is dispersed in 200 ml of ethyl alcohol under stirring for 48 hours, followed by filtration to recover a filtrate. Then, the absorption spectrum in the visible range of the filtrate is obtained and a relative absorbance at a wavelength showing an absorption, e.g., $\lambda$=480 nm, attributable to the metal complex is measured. The localization characteristic of the metal complex is evaluated by factors (ratios):

$OD_F/OD_M$ and $OD_C/OD_M$, wherein $OD_F$ denotes an absorbance of a filtrate obtained from classified fine powder, $OD_M$ denotes an absorbance of a filtrate obtained from classified medium powder and $OD_C$ denotes an absorbance of a filtrate obtained from classified coarse powder.

An azo-type iron complex compound represented by the above-mentioned formula (4) wherein $A^+$ comprises 75–98 mol. % of ammonium ions, has been found to exhibit a preferred performance in forming stable toner images. An azo-type iron complex compound having cations consisting solely of ammonium ions tends to provide a toner showing an image density which slowly increases after standing in a high-humidity environment. On the other hand, an azo-type iron complex compound having cations consisting only of protons or alkali metal ions tends to provide a toner showing a low image density in a high-humidity environment.

As a result of our study, the use of cations including both ammonium ions and alkali metal ions and/or protons provides a compound giving a toner showing a good performance after a long period of standing. The inclusion of ammonium ions at 75–98 mol. % provides particularly good results regarding image density increasing speed and image density level after the increase.

When the ammonium ion content is below 75%, the image density is lowered and, above 98%, the image density tends to increase slowly.

As a result of further study of ours, the azo-type iron complex compound used in the toner according to the present invention may preferably have a solubility in methanol of 0.1–8 g/100 ml, more preferably 0.3–4 g/100 ml, further preferably 0.4–2 g/100 ml.

In case where the solubility is below 0.1 g/100 ml, the charge control agent (azo-type iron complex compound) shows a low dispersibility in the toner even if the long-chain alkyl compound is used in combination, thus providing a toner which has an unstable triboelectric chargeability and is liable to cause image fog and scattering.

On the other hand, in case where the solubility exceeds 8 g 100 ml, the toner performances are liable to be affected by the temperature and humidity during a long period of standing in a high temperature - high humidity environment, so that the toner chargeability is impaired and it becomes difficult to obtain a sufficient image density.

The charge control agent may preferably be used in a proportion of 0.2–5 wt. parts per 100 wt. parts of the binder resin.

The solubility of the charge control agent may be measured in the following manner.

<Solubility measurement of charge control agent>

2 g of a charge control agent is weighed and placed in a 300 ml Erlenmeyer flask to which 100 ml of methanol is added. The system is heated to 50° C. under stirring and the stirring is further continued for 1 hour (when all the charge control agent is dissolved, the charge control agent is further added successively at an increment of 2 g each under continued stirring). Then, the system is cooled to room temperature and the insoluble charge control agent is removed by a 0.1 $\mu$m-filter to measure the absorbance (A) of the solution at a maximum absorption wavelength by using a spectrophotometer.

On the other hand, a standard solution of the charge control agent (at a concentration Co (=0.02 g/1 (=20 ppm)) is prepared, and the absorbance (Ao) thereof is measured. From these data, the solubility of the charge control agent (C (g/1)) is calculated by A/Ao=C/Co, based on the Lambert-Beeis law represented by the following formula:

$$A=\log_e (I_0/I)=\epsilon_0 Cd,$$

wherein I denotes a transmitted light intensity through a solution, $I_0$ denotes a transmitted light intensity through a solvent (=methanol), $\epsilon_0$ denotes an absorption coefficient, C denotes the concentration of the charge control agent, and d denotes the thickness of the solution for the absorbance measurement.

The azo-type iron complex compound used in the present invention has a structure represented by the following general formula (4):

(4)

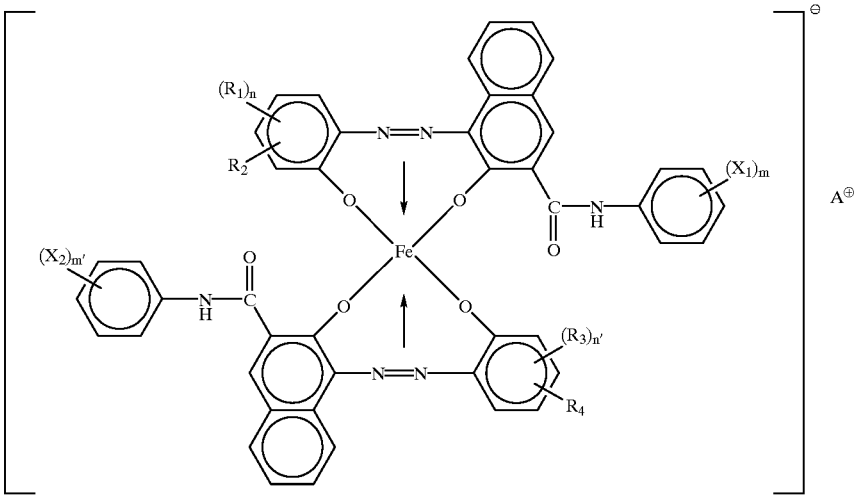

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sulfonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^+$ denotes a cation including 75–98 mol. % of ammonium ion and another ion selected from the group consisting of hydrogen ion, sodium ion, potassium iron and mixtures thereof.

The above azo-type iron complex which is suitably used as a negative charge control agent may be synthesized according to a known process.

The negative charge control agent may be used singly or in combination of two or more species or in combination with another negative charge control agent.

Representative examples of the azo-type iron complex represented by the above formula may include those having structures as shown below wherein $A^{\oplus}$denotes the same meaning as defined above:

Iron Complex (1)

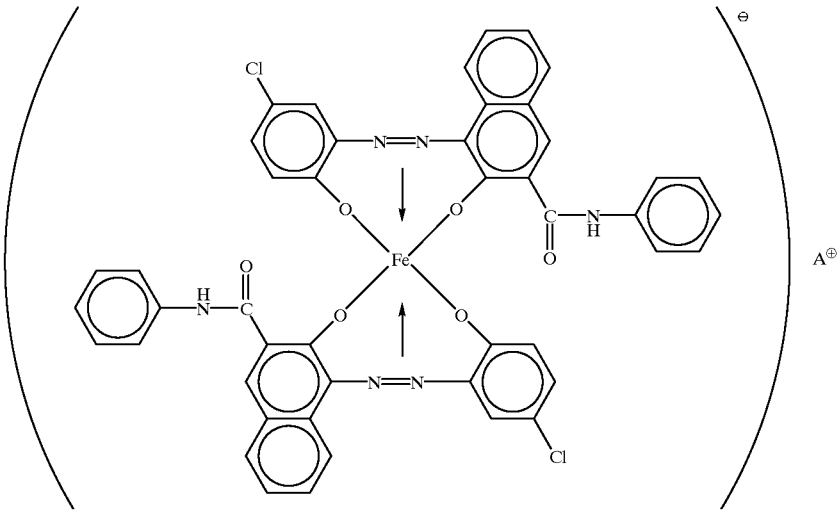

-continued
Iron Complex (2)
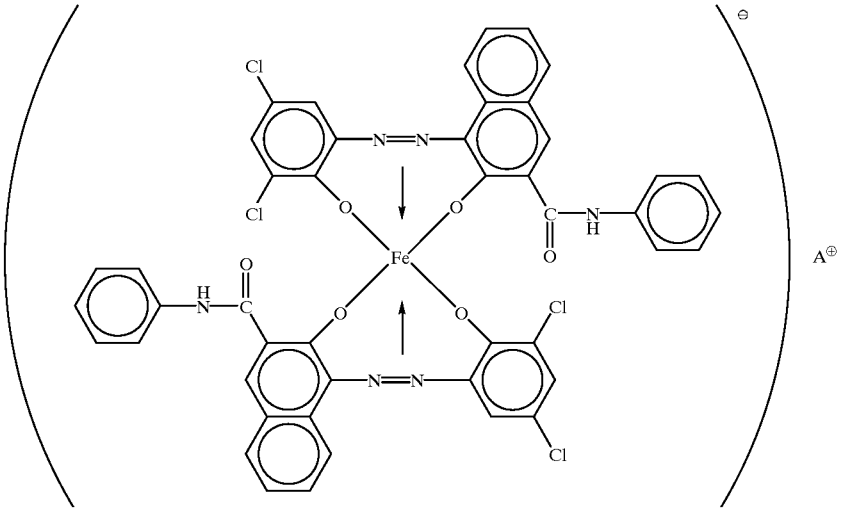
Iron Complex (3)
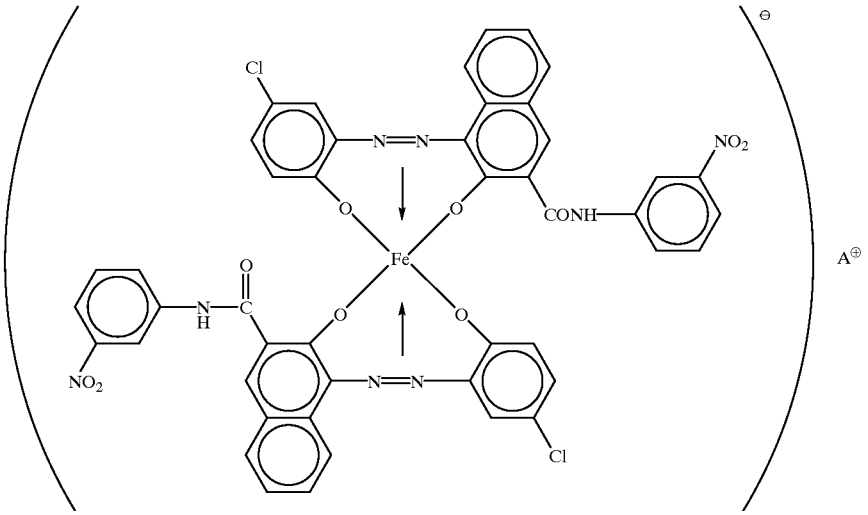
Iron Complex (4)
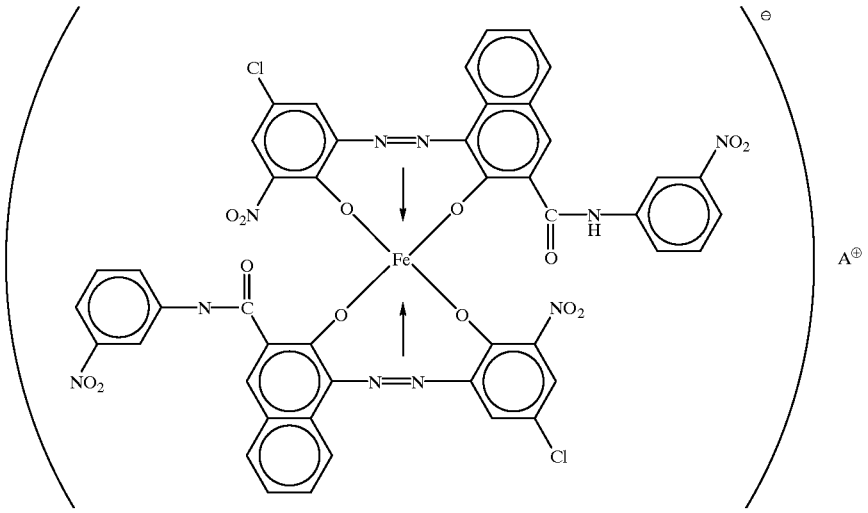

-continued

Iron Complex (5)

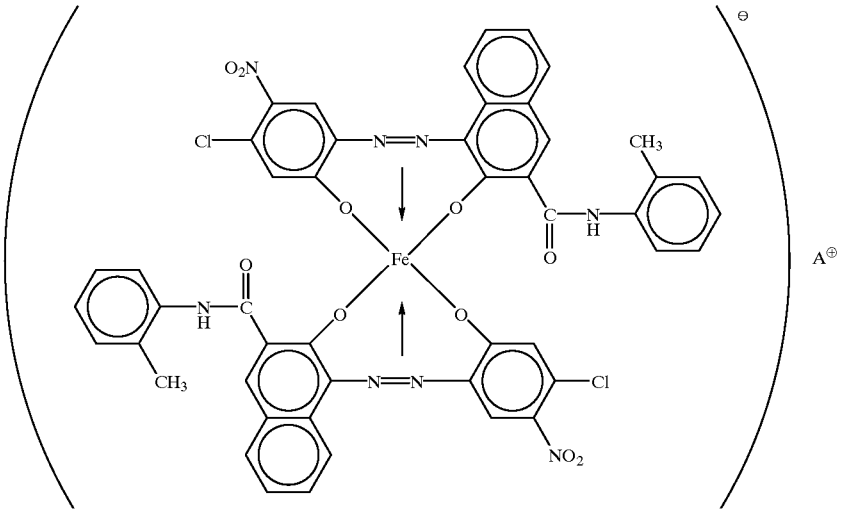

Iron Complex (6)

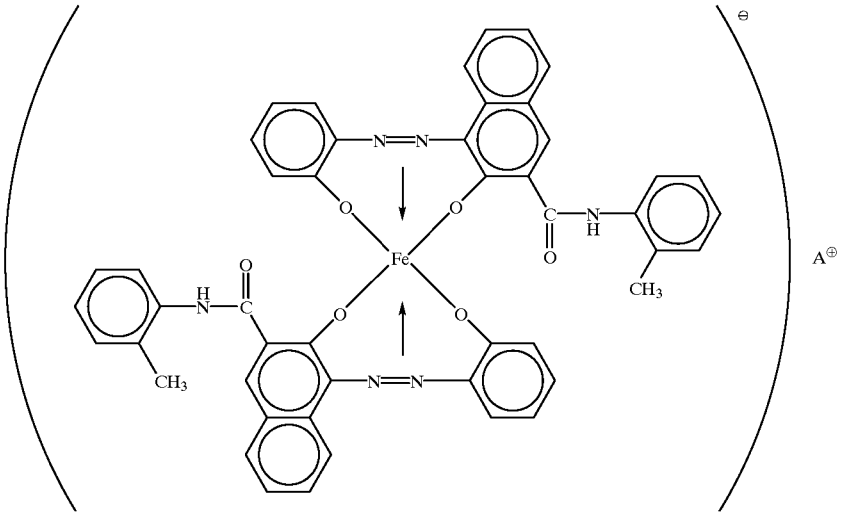

In the toner for developing the electrostatic images the azo-type ion complex may preferably be used in an amount of 0.1–10 wt. parts, more preferably 0.1–5 wt. parts, per 100 wt. parts of the binder resin.

The long-chain alkyl compound used in the present invention may be represented by the following formula (1), (2) or (3).

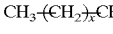

$$CH_3\text{-}(CH_2)_x\text{-}CH_2OH \quad (1),$$

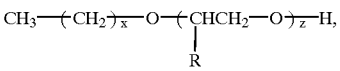

$$CH_3\text{-}(CH_2)_x\text{-}O\text{-}(CHCH_2\text{-}O)_z\text{-}H, \quad (2)$$

wherein x denotes an average value in the range of 35–150; z denotes an average value in the range of 1–5, and R denotes H or an alkyl group having 1–10 carbon atoms.

The long-chain alkyl compound of the above formulae may for example be produced as follows. Ethylene is polymerized in the presence of a Ziegler catalyst and, after the polymerization, oxidized to provide an alkoxide of the catalyst metal and polyethylene, which is then hydrolyzed to provide an objective long-chain alkyl compound of formula (1). By reacting the long-chain alkyl alcohol of formula (1) with an epoxy group-containing substance, it is possible to obtain a long-chain alkoxy alcohol of formula (2). The thus prepared long-chain alkyl alcohols have little branching and a sharp molecular weight distribution and are suitably used in the present invention.

$$CH_3\text{-}(CH_2)_y\text{-}CH_2COOH \quad (3),$$

wherein y denotes an integer of 35–150.

The long-chain alkyl compound of formula (3) may be obtained by oxidizing the long-chain alkyl compound of formula (1).

For the compound represented by the above formula (1), (2) or (3), x and y may preferably be 35–150. If x and y are below 35, the resultant toner is liable to cause melt-sticking onto the photosensitive member or a lower storage stability. If x and y are larger than 150, the above-mentioned contribution to toner chargeability (i.e., promoting the formation of microdomains of the azo-type iron complex) is lowered, thus being unsuitable for accomplishing the object of the present invention. z is preferably at most 5. If z is larger than 5, the resultant toner is liable to cause melt-sticking onto the photosensitive member. For similar reasons, it is preferred that R is H or a $C_1$–$C_{10}$ alkyl group.

The long-chain alkyl compound used in the present invention may suitably be a mixture of compounds having different molecular weights and can further contain at most 30 wt. %, preferably at most 25 wt. % of hydrocarbon compounds free from functional groups such as hydroxyl and carboxyl group as by-produced through the above-mentioned production processes of the compounds of the formulae (1)–(3). The long-chain alkyl compound may preferably have a number-average molecular weight (Mn) of 150–2500, a weight-average molecular weight (Mw) of 250–5000, and an Mw/Mn ratio of at most 3.

In case where Mn is below 150 or Mw is below 250, the toner is liable to cause melt-sticking onto the photosensitive member or a lower storage stability. In case where Mn exceeds 2500 or Mw exceeds 5000, the contribution to toner chargeability is lowered, thus being liable to cause problems, such as fog.

The long-chain alkyl compound of formula (1) or (2) used in the present invention may preferably have an OH value of 2–150 mgKOH/g, more preferably 10–120 mgKOH/g. If the long-chain alkyl compound has an OH value below 2 mgKOH/g, the dispersibility thereof in the binder resin is lowered to result in ununiform toner chargeability leading to a density decrease, fog, and inferior image quality in copy images. In case where the long-chain alkyl compound has an OH value exceeding 150 mgKOH/g, the localization of the OH group charge density is increased to exceed the charge density localization of the OH groups in the binder resin, so that copy images in the initial state of image formation are liable to have a low density and a poor image quality. Alternatively, even if the initial density is high, the density is liable to be lowered gradually on continuation of copying. Further, in case where the OH value exceeds 150 mgKOH/g, the long-chain alkyl compound is caused to contain a large amount of low-molecular weight molecules so that the resultant toner is liable to cause a melt-sticking onto the photosensitive member and lower the storage stability.

The long-chain alkyl compound of formula (3) used in the present invention may preferably have an acid value of 2–150 mgKOH/g, more preferably 5–120 mgKOH/g. If the long-chain alkyl compound has an acid value below 2 mgKOH/g, the dispersion thereof in the binder resin becomes worse, thereby resulting in inferior image qualities of copy images. Further, as the carboxyl groups do not sufficiently associate with each other, the environmental characteristic is liable to be impaired. Further, the resultant toner is liable to show a low charging velocity, to result in a lower density at the initial stage of copying. In case where the acid value of the long-chain alkyl compound exceeds 150 mgKOH/g, it contains a large amount of low-molecular weight molecules, the resultant toner is liable to cause melt-sticking onto the photosensitive member and lower the storage stability.

The long-chain alkyl compounds, when used singly, may preferably be contained in an amount of 0.1–30 wt. parts, particularly 0.5–20 wt. parts, per 100 wt. parts of the binder resin.

In case where the long-chain alkyl compounds are used in combination, the total amount thereof may preferably be 0.1–30 wt. parts, more preferably 0.5–20 wt. parts, per 100 wt. parts of the binder resin.

It is preferred for the toner according to the present invention to contain 3–90% by number of toner particles having a particle size of 5 $\mu$m or smaller. Hitherto, it has been considered difficult to control the charge imparted to toner particles of 5 $\mu$m or smaller. Further, such fine toner particles are considered to impair the fluidity of the toner, soil the carrier and developing sleeve, cause cleaning failure and filming onto the drum and scatter to soil the interior of an image forming apparatus. Thus, it has been considered necessary to remove or decrease toner particles of 5 $\mu$m or smaller.

As a result of our study, however, in case of a toner containing a specific long-chain alkyl compound and an azo-type iron complex of the above-mentioned formula, it has been found that toner particles of 5 $\mu$m or smaller are very effective for providing images of a fine definition and a high resolution.

In the toner used in the present invention, it is also preferred that toner particles of 6.35–10.08 $\mu$m constitute 1–80% by number and the toner has a weight-average particle size of 4.0–10 $\mu$m, more preferably 4.5–9.0 $\mu$m.

Toner particles of 5 $\mu$m or smaller are able to strictly cover and faithfully reproduce an electrostatic image, but an electrostatic image per se has a higher electric field intensity at the peripheral edge than the middle or central portion. As a result, toner particles are attached to the central portion in a smaller thickness than to the peripheral part, so that the inner part is liable to be thin in density. We have found that this problem can be solved to provide a clear image by using toner particles of 6.35–10.08 $\mu$m in a proportion of 1–80% by number. This may be attributable to a fact that toner particles of 6.35–10.08 $\mu$m are supplied to an inner part having a smaller intensity than the edge of a latent image presumably because they have a moderately controlled charge relative to toner particles of 5 $\mu$m or smaller, thereby to compensate for the reduced coverage of toner particles and result in a uniform developed image. As a result, a sharp image having a high density and excellent in resolution and gradation characteristic can be attained.

Further, it is most preferred that the contents of the toner particles of 5 $\mu$m or smaller in terms of % by number (N %) and % by volume (V %) satisfy the relationship of $N/V=-0.05N+k$, wherein $3 \leqq k \leqq 12$, and $5 \leqq N \leqq 90$. The toner having a particle size distribution satisfying the relationship in combination with the other characteristic features according to the present invention accomplishes a better developing performance with respect to a digital latent image composed of minute spots.

We have found a certain state of presence of fine powder accomplishing the intended performance satisfying the above formula during our study on the particle size distribution with respect to particles of 5 $\mu$m or smaller. For a certain value of N, a large N/V value is understood to mean that a large proportion of particles smaller than 5 $\mu$m are present with a broad particle size distribution, and a small N/V value is understood to mean that particles having a particle size in the neighborhood of 5 $\mu$m is present in a large proportion and particles smaller than that are present in a small proportion. A further better thin-line reproducibility and high resolution in a large quantity of copying or printing are accomplished when the N/V is in the range of 1.0–7.45, N is in the range of 5–90 and the above formula relationship is satisfied.

Toner particles of 12.7 $\mu$m or larger are suppressed to be not more than 2.0% by volume. The fewer of such particles, the better.

The particle size distribution of the toner used in the present invention is described more specifically below.

Toner particles of 5 $\mu$m or smaller may be contained in a proportion of 5–90% by number, further preferably 9–75% by number, of the total number of particles. If the content of the toner particles of 5 μm or smaller is below 5% by number, a portion of the toner particles effective for providing a high image quality is low and particularly, as the toner is consumed during a continuation of copying or printing-out, the effective component is preferentially consumed to result in an awkward particle size distribution of the toner which gradually deteriorates the image quality. If the content is above 90% by number, mutual agglomeration of the toner particles and charge-up are liable to occur, thus leading to difficulties, such as cleaning failure, a low image density, and a large difference in density between the contour and interior of an image to provide a somewhat hollow image.

It is preferred that the content of the particles in the range of 6.35–10.08 μm is 1–80% by number, further preferably 5–70% by number. Above 80% by number, the image quality becomes worse, and excess of toner coverage is liable to occur, thus resulting in a lower thin-line reproducibility and an increased toner consumption. Below 5% by number, it becomes difficult to obtain a high image density in some cases.

For similar reasons as N, V may preferably be 0.5–70% by volume.

The k value may preferably be 3–12, more preferably 4–10.

If k<3.0, toner particles of 5.0 μm or below are insufficient, and the resultant image density, resolution and sharpness decrease. When fine toner particles in a toner, which have conventionally been considered useless, are present in an appropriate amount, they are effective for achieving closest packing of toner in development and contribute to the formation of a uniform image. Particularly, these particles fill thin-line portions and contour portions of an image, thereby to visually improve the sharpness thereof. On the other hand, if k>12, an excess of fine powder is present, whereby the balance of particle size distribution can be disturbed during successive copying or print-out, thus leading to difficulties such as a somewhat lower image density and filming.

The amount of toner particles having a particle size of 12.7 μm or larger should be 2.0% by volume or smaller, preferably 1.0% by volume or smaller, more preferably 0.5% by volume or smaller. If the above amount is larger than 2.0% by volume, these particles are liable to impair thin-line reproducibility.

The toner used in the present invention may have a weight-average particle size of 4–10 μm, more preferably 4.5–9 μm. This value cannot be considered separately from the above-mentioned factors. If the weight-average particle size is below 4 μm, the toner is liable to cause soiling of the interior of an apparatus with scattered toner, a lowering in image density in a low-humidity environment and cleaning failure of the photosensitive member. If the weight-average particle size exceeds 9 μm, a minute spot of 100 μm or smaller cannot be developed with a sufficient resolution and noticeable scattering to non-image part is observed, thus being liable to provide inferior images.

Examples of the binder resin used in the toner of the present invention may include polyester resins, vinyl resins and epoxy resins. Among these, polyester resins or vinyl resins may preferably be used in view of charging characteristic and fixing characteristic.

A polyester resin preferably used in the present invention may have a composition that it comprises 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

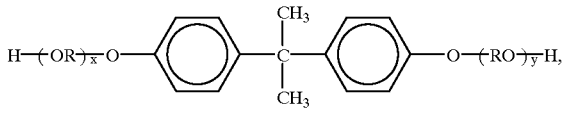

wherein R denotes an ethylene or propylene group, x and y are independently a positive integer of at least 1 with the proviso that the average of x+y is in the range of 2–10; diols represented by the following formula (B):

(B)

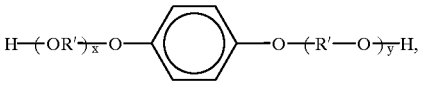

wherein R' denotes —$CH_2CH_2$—,

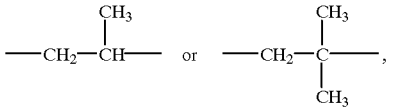

x' and y' are a positive integer of at least 1 with the proviso that the average of x'+y' is in the range of 1–10.

Examples of the dibasic acid constituting at least 50 mol. % of the total acid may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride.

The polyester resin may preferably have a glass transition temperature of 40–90° C., particularly 45–85° C., a number-average molecular weight (Mn) of 1,000–50,000, particularly 1,500–20,000, and a weight-average molecular weight (Mw) of $3\times10^3$–$5\times10^6$, particularly $4\times10^3$–$1.5\times10^6$.

Examples of a vinyl monomer for providing the vinyl resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; the esters of the above-mentioned $\alpha$, $\mu$-unsaturated acids and the diesters of the above-mentioned dibasic acids.

Examples of a carboxy group-containing vinyl monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; $\alpha,\beta$-unsaturated acids, such as acrylic acid, methacrylic acid, crotonic acid, and cinnamic acid; $\alpha,\beta$-unsaturated acid anhydrides, such as crotonic anhydride, and cinnamic anhydride; anhydrides between such an $\alpha,\beta$-unsaturated acid and a lower aliphatic acid; alkenylmalonic acid, alkenylglutaric acid, alkenyladipic acid, and anhydrides and monoesters of these acids.

It is also possible to use a hydroxyl group-containing vinyl monomer: inclusive of acrylic or methacrylic acid esters, such as 2-hydroxyethyl acrylate, and 2-hydroxyethyl methacrylate; 4-(1-hydroxy-1-methylbutyl)styrene, and 4-(1-hydroxy-1-methylhexyl)styrene.

The vinyl resin may have a glass transition point of 45–80° C., preferably 55–70° C., a number-average molecular weight (Mn) of $2.5\times10^3$–$5\times10^4$, and a weight-average molecular weight (Mw) of $1\times10^4$–$1.5\times10^6$.

In the present invention, it is also possible to use a mixture binder resin including a vinyl homopolymer or copolymer, a polyester, polyester, epoxy resin, polyvinyl butyral, rosin, modified rosin, terpene resin, phenolic resin, aliphatic or alicyclic-hydrocarbon resin or aromatic petroleum resin, in addition to the above-mentioned binder resin.

In case of using a mixture binder resin including two or more resins of the same or different types, the two or more resins may preferably have different molecular weights and may be mixed with each other in appropriate ratios.

The toner according to the present invention may be either a magnetic toner or a non-magnetic toner. In order to constitute a magnetic toner, it is preferred to use a magnetic material as described below.

Examples of the magnetic material contained in the insulating magnetic toner used in the present invention may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size (Dav.) of 0.1–2 $\mu$m, preferably 0.1–0.3 $\mu$m. The magnetic material may preferably show magnetic properties when measured by application of 10 kilo-Oersted, inclusive of: a coercive force (Hc) of 20–150 Oersted, a saturation magnetization ($\sigma s$) of 50–200 emu/g, particularly 50–100 emu/g, and a residual magnetization (or) of 2–20 emu/g.

The magnetic material may be contained in the toner in a proportion of 10–200 wt. parts, preferably 20–150 wt. parts, per 100 wt. parts of the binder resin.

The toner according to the present invention may optionally contain a colorant, inclusive of arbitrary pigments or dyes.

Examples of the pigment may include: carbon black, aniline black, acetylene black, Naphthol Yellow, Hansa Yellow, Rhodamina Lake, Alizarine Lake, red iron oxide, Phthalocyanine Blue, and Indanthrene Blue. It is preferred to use 0.1–20 wt. parts, particularly 1–10 wt. parts, of a pigment per 100 wt. parts of the binder resin. For similar purpose, there may also be used dyes, such as azo dyes, anthraquinone dyes, xanthene dyes, and methine dyes, which may preferably be used in an amount of 0.1–20 wt. parts, particularly 0.3–10 wt. parts, per 100 wt. parts of the resin.

In the present invention, it is also possible to incorporate one or two or more species of release agent, as desired, within a toner.

Examples of the release agent may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, behenyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'- distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

The particularly preferred class of release agent in the present invention may include aliphatic hydrocarbon waxes because of good dispersibility within the binder resin (preferably one having an acid value of 5–50), thus providing not only a good fixability of the resultant toner but also a minimum abrasion of an organic photoconductor when used in combination with the toner according to the present invention.

Specific examples of the release agent preferably used in the present invention may include e.g., a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a hydrocarbon mixture and distilling the hydrocarbon mixture to recover a residue. Fractionation of wax may preferably be performed by the press sweating method, the solvent method, vacuum distillation or fractionating crystallization. As the source of the hydrocarbon wax, it is preferred to use hydrocarbons having up to several hundred carbon atoms as obtained through synthesis from a mixture of carbon monoxide and hydrogen in the presence of a metal oxide catalyst (generally a composite of two or more species), e.g., by the Synthol process, the hydrocol process (using a fluidized catalyst bed), and the Arge process (using a fixed catalyst bed) providing a product rich in waxy hydrocarbon, and hydrocarbons obtained by polymerizing an alkylene, such as ethylene, in the presence of a Ziegler catalyst, as they are rich in saturated long-chain linear hydrocarbons and accompanied with few branches. It is further preferred to use hydrocarbon waxes synthesized without polymerization because of their structure and molecular weight distribution suitable for easy fractionation.

As for the molecular weight distribution of the wax, it is preferred that the wax shows a peak in a molecular weight region of 400–2400, further 450–2000, particularly 500–1600. By satisfying such molecular weight distribution, the resultant toner is provided with preferable thermal characteristics.

The release agent may preferably be used in an amount of 0.1–20 wt. parts, particularly 0.5–10 wt. parts, per 100 wt. parts of the binder resin.

The release agent may be uniformly dispersed in the binder resin by a method of mixing the release agent in a solution of the resin at an elevated temperature under stirring or melt-kneading the binder resin together with the release agent.

A flowability-improving agent may be optionally blended with the toner to improve the flowability of the toner. Examples thereof may include: powder of fluorine-containing resin, such as polyvinylidene fluoride fine powder and polytetrafluoroethylene fine powder; titanium oxide fine powder, hydrophobic titanium oxide fine powder; fine powdery silica such as wet-process silica and dry-process silica, and treated silica obtained by surface-treating such fine powdery silica with silane coupling agent, titanium coupling agent, silicone oil, etc.

A preferred class of the flowability-improving agent includes dry process silica or fumed silica obtained by vapor-phase oxidation of a silicon halide. For example, silica powder can be produced according to the method utilizing pyrolytic oxidation of gaseous silicon tetrachloride in oxygen-hydrogen flame; and the basic reaction scheme may be represented as follows:

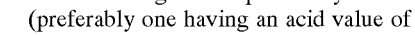

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having an average primary particle size of 0.001–2 μm, particularly 0.002–0.2 μm.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | TT 600 |
| | MOX 170 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, etc., reactive with or physically adsorbed by the silica fine powder.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

The flowability-improving agent used in the present invention may have a specific surface area of at least 30 $m^2/g$, preferably 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner.

In case where the toner according to the present invention is used for constituting a two-component type developer, the toner is blended with a carrier. Examples of the carrier used in the present invention may include: surface-oxidized or -unoxidized powder of metals, such as iron, nickel, copper, zinc, cobalt, manganese, chromium and rare earth metals, particles of alloys of these metal, oxide particles, and ferrite particles.

A coated carrier obtained by coating the above carrier particles with a resin may preferably be used particularly in a developing method wherein a developing bias is supplied with an AC bias voltage. The coating may be performed according to known methods inclusive of a method applying a coating liquid obtained by dissolving or suspending a coating material such as a resin into a solvent onto the surface of carrier core particles, and a method of powder blending carrier core particles and a coating material.

Examples of the coating material firmly applied onto the core particles may include: polytetrafluoroethylene, monochlorotrifluoroethylene polymer, polyvinylidene fluoride, silicone resin, polyester resin, styrene resin, acrylic resin, polyamide, polyvinyl butyral, aminoacrylate resin, basic dyes and lakes thereof, silica fine powder and alumina fine powder. These coating materials may be used singly or in combination of plural species.

The coating material may be applied onto the core particles in a proportion of 0.1–30 wt. %, preferably 0.5–20 wt. %, based on the carrier core particles. The carrier may preferably have an average particle size of 10–100 $\mu$m, more preferably 20–70 $\mu$m.

A particularly preferred type of carrier may comprise particles of a magnetic ferrite such as Cu-Zn-Fe ternary ferrite surface-coated with a fluorine-containing resin or a styrene-based resin. Preferred coating materials may include mixtures of a fluorine containing resin and a styrene copolymer, such as a mixture of polyvinylidene fluoride and styrene-methyl methacrylate resin, and a mixture of polytetrafluoroethyelene and styrene-methyl methacrylate resin. The fluorine-containing resin may also be a copolymer, such as vinylidene fluoride/tetrafluoroethylene (10/90–90/10) copolymer. Other-examples of the styrene-based resin may include styrene/2-ethylhexyl acrylate (20/80–80/20) copolymer and styrene/2-ethylhexyl acrylate/methyl methacrylate (20–60/5–30/10–50) copolymer. The fluorine-containing resin and the styrene-based resin may be blended in a weight ratio of 90:10–20:80, preferably 70:30–30:70. The coating amount may be 0.01–5 wt. %, preferably 0.1–1 wt. % of the carrier core.

The coated magnetic ferrite carrier may preferably include at least 70 wt. % of particles of 250 mesh-pass and 400 mesh-on, and have an average particle size of 10–100 $\mu$m, more preferably 20–70 $\mu$m. A sharp particle size distribution is preferred.

The characteristic values of a binder resin and a long-chain alkyl compound and the particle size distribution of a toner referred to herein may be measured according to the following methods.

(1) Glass Transition Temperature Tq

Measurement may be performed in the following manner by using a differential scanning calorimeter ("DSC-7", available from Perkin-Elmer Corp.).

A sample in an amount of 5–20 mg, preferably about 10 mg, is accurately weighed.

The sample is placed on an aluminum pan and subjected to measurement in a temperature range of 30–200° C. at a temperature-raising rate of 10° C./min in a normal temperature—normal humidity environment in parallel with a blank aluminum pan as a reference.

In the course of temperature increase, a main absorption peak appears in the temperature region of 40–200° C.

In this instance, the glass transition temperature is determined as a temperature of an intersection between a DSC curve and an intermediate line pressing between the base lines obtained before and after the appearance of the absorption peak.

(2) Molecular Weight Distribution (for binder resin)

The molecular weight (distribution) of a binder resin may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 $\mu$l of a GPC sample solution adjusted at a concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$2\times10^6$. A preferred example thereof may be a combination of $\mu$-styragel 500, $10^3$, $10^4$ and $10^5$ available from Waters Co.; a combination of Shodex KF-801, 802, 803, 804, 805, 806 and 807 available from Showa Denko K.K.

(3) Molecular Weight Distribution (for long-chain alkyl compound)

The molecular weight (distribution) of a long-chain alkyl compound may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

(4) Measurement of Acid Values and OH Values 1) re: Acid value

A sample material is accurately weighed and dissolved in a mixture solvent, and water is added thereto. The resultant liquid is titrated with 0.1N-NaOH by potentiometric titration using glass electrodes (according to JIS K1557–1970).

2) re: Hydroxyl value (OH value)

A sample is accurately weighed into a 100 ml-volumetric flask, and 5 ml of an acetylating agent is accurately added thereto. Then, the system is heated by dipping into a bath of 100° C.±5° C. After 1–2 hours, the flask is taken out of the bath and allowed to cool by standing, and water is added thereto, followed by shaking to decompose acetic anhydride. In order to complete the decomposition, the flask is again heated for more than 10 min. by dipping into the bath. After cooling, the flask wall is sufficiently washed with an organic solvent. The resultant liquid is titrated with a N/2-potassium hydroxide solution in ethyl alcohol by potentiometric titration using glass electrodes (according to JIS K0070–1966).

(5) Particle Size Distribution Measurement

Coulter Multisizer II (available from Coulter Electronics Inc.) is used as an instrument for measurement, to which an interface (available from Nikkaki K.K.) for providing a number-basis distribution, and a volume-basis distribution and a personal computer PC 9801 (available from NEC K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant (preferably an alkylbenzenesulfonic acid salt) is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 $\mu$m by using the above-mentioned Coulter Multisizer II with a 100 micron-aperture to obtain a volume-basis distribution and a number-basis distribution. Form the results of the volume-basis distribution and number-basis distribution in the range of 2–40 $\mu$m, a weight-average particle size (D4) is calculated with a central value of each channel taken as a representative value of the channel.

Next, an embodiment of the image forming method according to the present invention will be described with reference to FIGS. 1–3. FIG. 1 shows an electrophotographic apparatus usable as an example of a copying machine or a printer for practicing the image forming method according to the present invention. The apparatus includes a developing means 1 containing a toner 13 according to the present invention. The toner may be a magnetic toner or a non-magnetic toner. In an image forming apparatus other than the one shown in FIG. 1, it is possible to use a developing means including a two-component type developer comprising a toner and a carrier.

Referring again to FIG. 1, the surface of a photosensitive member 3 (e.g., an OPC photosensitive drum, an amorphous silicon photosensitive drum or a polysilicon photosensitive drum) is charged by a charging means 11 (e.g., a contact charging means such as a charging roller as shown, a charging brush or a charging blade) supplied with a voltage from a bias voltage application means 34. Then, the charged surface of the photosensitive member 3 is irradiated with light 5 (e.g., laser light or light from a halogen lamp) carrying image data to form an electrostatic image on the photosensitive member. The electrostatic image is developed with a magnetic toner 13 (in this embodiment) on a developing sleeve 6 enclosing a magnetic field generating means 15 (e.g., a magnet) of the developing means 1 also equipped with a toner applicator blade 8 (e.g., an elastic blade or a magnetic blade) for applying the toner 13 onto the developing sleeve 6. The development is performed by either the normal development scheme or the reversal development scheme to form a toner image on the photosensitive member 3. At the developing station, the developing sleeve may be supplied, as desired, with an alternating, a pulse, and/or a DC bias voltage from a bias voltage application means 12. When the toner image on the photosensitive member 3 arrives at a transfer station to which also a transfer material is conveyed, the back side (side opposite the photosensitive member 3) of the transfer member P is pressed and charged by a transfer means 4 (e.g., a transfer roller as shown or a transfer belt) to which a voltage is applied from a bias application means 33, to electrostatically transfer the toner image on the photosensitive member 3 onto the transfer material P. As the case may be, the toner image on the photosensitive member 3 can be transferred onto an intermediate transfer member (not shown, such as an intermediate transfer drum or an intermediate transfer belt) and then to the transfer material P.

The toner image on the transfer material P separated from the photosensitive member 3 may be fixed onto the transfer material P by a heat-and-pressure application means 35 (e.g., a fixing means as shown wherein a pressure roller 23 is pressed against a fixed heat-generating member 21 via a heat-resistant sheet 22; or a heat-pressure roller fixing means). A portion, if any, of the toner remaining on the photosensitive member 3 after the transfer step may be removed, as desired, from the surface of the photosensitive member 3 by a cleaning means 7 (e.g., a cleaning blade as shown, a cleaning roller or a cleaning brush). The photosensitive member 3 after the cleaning is again subjected to an image forming cycle as described above starting from the charging step by the charging means 11.

The photosensitive member 3 as a member to be charged and also an electrostatic image-bearing member generally comprises a photosensitive layer and an electroconductive substrate and is rotated in the direction of an arrow as indicated. The developing sleeve 6 comprising a non-magnetic cylinder as a toner carrying member is rotated in the same direction as the photosensitive member 3 at the developing station. Inside the developing sleeve 6, a multipolar permanent magnet (magnet roll) 15 as a magnetic field-generating means is fixedly disposed. The magnetic toner 13 contained inside the developing means 1 is applied by the applicator blade 8 onto the surface of the developing sleeve, and the toner particles constituting the toner are triboelectrically charged by friction with the applicator blade 8 and/or the developing sleeve 6. The toner may be uniformly applied by the applicator blade 8 in a layer of e.g., 10–300 $\mu$m on the surface of the developing sleeve 6. At the developing station, the developing sleeve 6 may be supplied with an AC bias voltage of f=200–4000 Hz and Vpp=500–3000 V.

At the developing station, toner particles are transferred onto the electrostatic image on the photosensitive member due to the electrostatic force of the photosensitive member surface and the action of an AC or pulse bias voltage.

Figure 2:
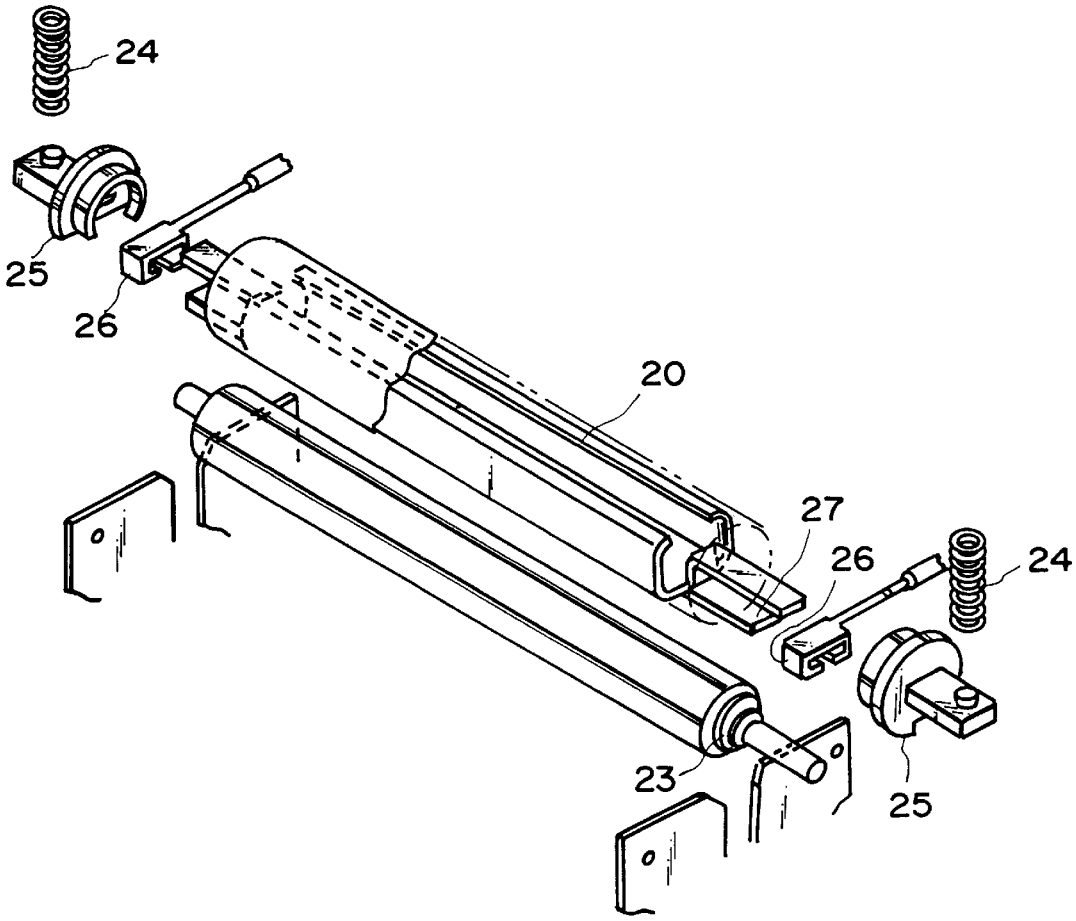
FIG. 2 is an exploded perspective view of essential parts of a fixing apparatus used in Examples of the invention.
Figure 3:
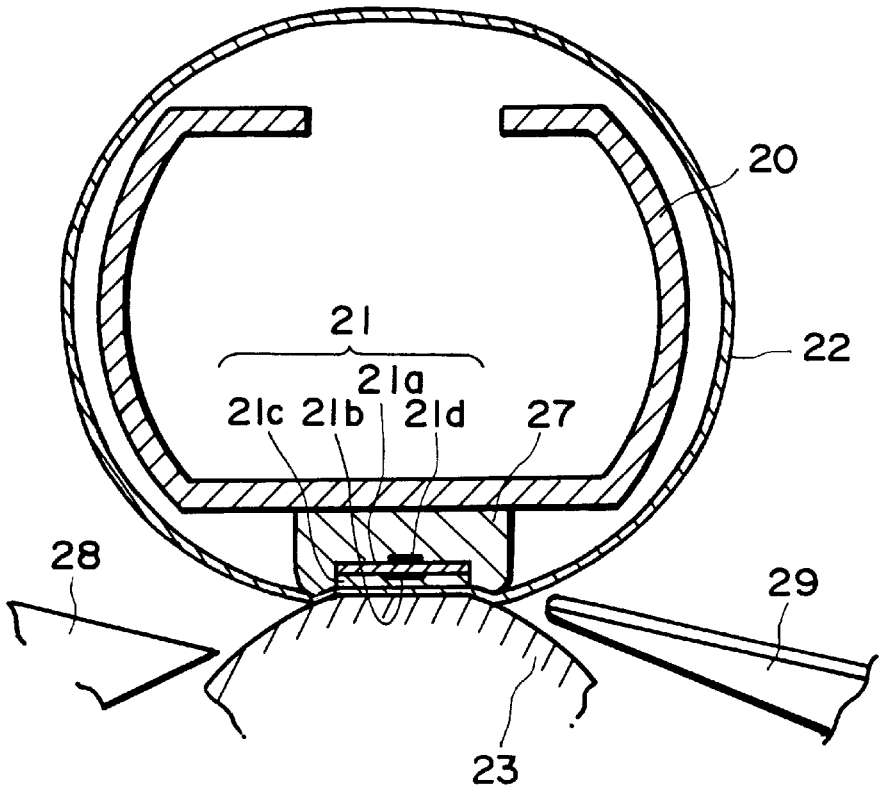
FIG. 3 is an enlarged sectional view of a fixing apparatus including a film in a non-driven state used in Examples of the present invention.

Incidentally, in Examples described hereinafter, an image forming apparatus having structure as shown in FIGS. 1 to 3 was used, of which the included members are denoted by reference numerals as shown below.

That is, reference numeral 3 denotes an electrostatic image-bearing member (photosensitive drum); 11, a charger (charging roller); 2, a process-cartridge; 7, a cleaning means; 5, an exposure means; 15, a developer container; 6, a developer-carrying member (developing sleeve); 15, a magnetic field generating means; 8, a layer thickness-regulating elastic member; 4, a transfer means (transfer roller); 20, a stay; 21, a heating member; 21*a*, a heater substrate; 21*b*, a heat-generating member; 21*c*, a surface protective layer; 21*d*, a temperature-detecting element; 22, a fixing film; 23, a pressing roller; 24, a coil spring; 25, a film edge-regulating member; 26, an electricity-supplying connector; 27, an electricity interrupting member; 28, an inlet guide; and 29, an outlet guide (separation guide).

Figure 5:
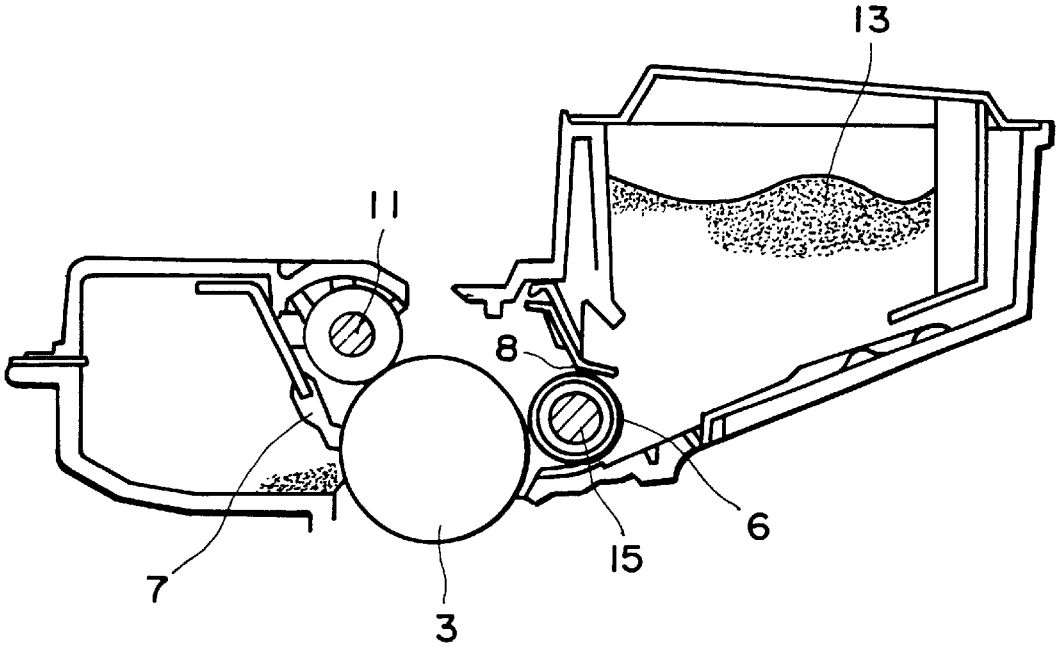
FIG. 5 is a schematic illustration of an embodiment of the process-cartridge according to the present invention.

Further, FIG. 5 is a schematic sectional view of a process-cartridge detached from a main body of an image forming apparatus as described above. The process-cartridge at least includes a developing means and an electrostatic image-bearing member which are integrated into a cartridge, so as to be detachably mountable to a main body of an image forming apparatus, such as a copying machine or a laser beam printer.

In this embodiment shown in FIG. 5, the process-cartridge integrally includes a developing means 1, a drum-shaped electrostatic image bearing member (photosensitive drum) 3, a cleaner including a cleaning blade 7, and a primary charger (charging roller) 11.

In this embodiment, the developing means 1 includes a toner layer thickness-regulating member 8 and a toner vessel containing a magnetic toner 13. At the time of development, a prescribed bias electric field is applied between the photosensitive drum 3 and the developing sleeve 6 carrying the magnetic toner 13 to effect a development of an electrostatic image formed on the photosensitive drum 3.

Hereinbelow, the present invention will be described based on specific Examples.

| Resin Production Example 1 | |
|---|---|
| Terephthalic acid | 12 mol. % |
| Fumaric acid | 18 mol. % |
| Adipic acid | 10 mol. % |
| Trimellitic anhydride | 12 mol. % |
| Bisphenol derivatives of the above-described formula (A) | |
| (R = propylene, x + y = 2.2) | 15 mol. % |
| (R = ethylene, x + y = 2.2) | 33 mol. % |

The above ingredients were subjected to polycondensation to obtain a polyester (called "Resin A") having Mn=5,000, Mw=57,000, Tg=60° C., acid value=20, OH value=20.

| Resin Production Example 2 | |
|---|---|
| Styrene | 87 wt. parts |
| Butyl acrylate | 13 wt. parts |
| Di-tert-butyl peroxide | 3 wt. parts |

The above ingredients were added dropwise in 4 hours to 200 wt. parts of xylene heated to the reflux temperature. Further, the polymerization was completed under xylene reflux (138–144° C.), followed by heating to 200° C. under a reduced pressure to remove the xylene. The thus-obtained resin is called "Resin B".

| | |
|---|---|
| Styrene | 75 wt. part (s) |
| Butyl acrylate | 25 wt. part (s) |
| 2,2-Bis(4,4-di-tert-butyl-peroxycyclohexyl)propane | 0.1 wt. part (s) |
| Benzoyl peroxide | 0.1 wt. part (s) |

To a mixture liquid comprising the above ingredients, 170 wt. parts of water containing 0.12 wt. part of partially saponified polyvinyl alcohol was added, and the system was vigorously stirred to form a suspension liquid. The suspension liquid was added to a reaction vessel containing 50 wt. parts of water and aerated with nitrogen, and was subjected to suspension polymerization at 80° C. for 8 hours. After the reaction, the product was washed to obtain Resin C.

The above Resin B and Resin C at a weight ratio of 70:30 were dissolved in xylene and uniformly mixed, followed by removal of xylene to obtain Resin D, which showed a molecular weight distribution providing peaks at molecular weights of $1.2\times10^4$ and $8\times10^5$, Mn (number-average molecular weight)=$0.7\times10^4$ and Mw (weight-average molecular weight)=$2.5\times10^5$, and Tg=61° C.

| Resin Production Example 3 | |
|---|---|
| Styrene | 80.0 wt. parts |
| Butyl acrylate | 10.0 wt. parts |
| Monobutyl maleate | 10.0 wt. parts |
| Di-tert-butyl peroxide | 6.0 wt. parts |

Resin E was prepared from the above ingredients otherwise in the same manner as in production of Resin B in Resin Production Example 2 above.

| | |
|---|---|
| Resin E | 40.0 wt. part(s) |
| Styrene | 45.0 wt. part(s) |
| Butyl acrylate | 15.0 wt. part(s) |
| Divinylbenzene | 0.5 wt. part(s) |
| Benzoyl peroxide | 0.5 wt. part(s) |

A mixture liquid comprising the above ingredients was subjected to suspension polymerization in the same manner as in production of Resin C in Resin Production Example 2 to obtain Resin F, which showed Tg=60° C., Mn=$1\times10^4$ and Mw $1\times10^5$.

EXAMPLE 1

| | |
|---|---|
| Resin A | 100 wt. parts |
| Magnetic iron oxide (average particle size (Dav.) = 0.15 $\mu$m, Hc = 115 oersted, $\sigma_s$ = 80 emu/g, $\sigma_r$ = 11 emu/g) | 90 wt. parts |
| Long-chain alkyl alcohol of Formula (1) (x = 48 as an average value, Mn = 440, Mw = 870, Mw/Mn = 1.98, OH value = 66) | 3 wt. parts |
| Azo-type iron complex (1) | 2 wt. % |

-continued

| |
|---|
| ($A^+$ = 90%:$NH_4$, 10%:$Na^+$ and $H^+$ mixture; $S_{MeOH}$ (solubility in methanol) = 0.87 g/100 ml) |

The above ingredients were pre-mixed by a Henschel mixer and melt-kneaded through a twin screw extruder at 130° C. After cooling, the melt-kneaded product was coarsely crushed by a cutter mill, pulverized by a jet stream pulverizer, and classified by a pneumatic classifier to obtain a magnetic toner (1) having a weight-average particle size ($D_4$) of 6.6 μm, content of ≦5 μm particles: 49.3% (N, % by number), 9.6% (V, % by volume). The characterizing data of the toner are summarized in Table 1.

The localization factors of the azo-type iron complex in the fine and coarse power fractions were $OD_F/OD_M$=1.012 and $OD_C/OD_M$=0.998.

100 wt. parts of the magnetic toner (1) and 1.0 wt. part of hydrophobic silica surface-treated with hexamethyldisilazane were blended in a Henschel mixer to obtain Developer No. 1.

The thus-obtained Developer No. 1 was charged in a commercially available digital copying machine ("GP-55", available from Canon K.K.) and subjected to image formation of $5\times10^4$ sheets under normal temperature/low humidity (N/L=23.5° C./5%RH) conditions and further $3\times10^4$ sheets under high temperature/high humidity (H/H=32.5° C./80%RH) conditions. Further, Developer No. 1 was also charged in a commercially available analog copying machine ("NP-9800", available from Canon K.K.) and subjected to image formation of $2\times10^5$ sheets under the normal temperature/low humidity (N/L) conditions and further $1\times10^5$ sheets under the high temperature/ high humidity (H/H) conditions. The results of the image formation tests are shown in Tables 3 and 4.

In Tables 3 and 4, the evaluation results are indicated by symbols respectively indicating the following performances.

⊙: Very good o: Good oΔ: Practically of no problem

Δ: Slightly problematic x: Practically unacceptable

Further, a commercially available laser beam printer ("LBP-SX", available from Canon K.K.) was remodeled as shown in FIG. 1 (schematic view). More specifically, the process cartridge 2 was equipped with a urethane rubber-made elastic blade 8 and a charging roller 9. Further, the main body was equipped with a charging roller 4 and the heat-fixing apparatus was remodeled into an apparatus 35 shown in FIG. 1, FIG. 2 (exploded perspective view) and FIG. 3 (sectional view). Image formation was performed by using Developer No. 1 under the following conditions.

An OPC photosensitive member 3 was primarily charged at a,potential of −600 volts and exposed to form an electrostatic latent image thereon having a light part potential $V_L$ of −150 volts. At the developing station, the photosensitive drum 3 and the developing sleeve 6 (enclosing a magnet 15) were disposed with a gap of 300 μm so that the developer layer on the sleeve 6 did not contact the photosensitive member 3, and an AC bias (f=1800 Hz, Vpp=1500 V and a DC bias ($V_D$=−400 V) were applied in superposition from a bias application means 12 to the developing sleeve 6, thereby developing the electrostatic latent image by a reversal development scheme to form a toner image on the OPC photosensitive member 3. The thus-formed toner image was transferred onto plain paper by applying a positive transfer potential and the plain paper carrying the toner image was applied through the heat fixing apparatus 35 to fix the toner image onto the plain paper. In the heat-fixing apparatus, the surface temperature detected by a sensor element **22*d* of a heating member 21 was set to 130° C., and a total pressure of 6 kg was applied between the heating member 21 and a pressing roller 23 with a nip of 3 mm between the pressing roller 23 and a fixing film 22. The fixing film 22** comprised a 50 μm-thick heat-resistant polyimide film coated, on its side contacting the transfer material P, with a low-resistivity release layer comprising polytetrafluoroethylene with an electroconductive substance dispersed therein.

Under the above set conditions, an image formation test (a printing test) was performed continuously for 7000 A4-sheets at a rate of 8 A4-sheets/min. while replenishing the developer as required under normal temperature/normal humidity (N/N=25° C./60%RH) conditions.

Similar image formation tests were performed under high temperature/high humidity (H/H=32.5° C./90% RH) conditions and low temperature/low humidity (L/L=10° C./15%RH) conditions. In the high temperature—high humidity environment, after a 6500 sheets image formation test, the apparatus and developer were left standing for 5 days in the same environment and then further subjected to a 500 sheet image formation test.

The results are shown in Tables 5 and 6.

EXAMPLES 2–21 AND COMPARATIVE EXAMPLES 1–4

Toners having particle size distributions respectively shown in Table 1 were prepared in the same manner as in Example 1 except that prescriptions also shown in Table 1 were used. (In Table 1, values x, y and z are average values.) The localization factors of the metal complex compounds (inclusive of azo-type iron complex compound used in Examples) for the respective toners are shown in Table 2. From these toners, Developers Nos. 2–21 and Comparative Developers Nos. 1–4 were prepared in the same manner as in Example 1.

The resultant developers were respectively evaluated by the same image formation as in Example 1. The results are summarized in Tables 3–6.

The evaluation items listed in Tables 3–6 are supplemented hereinbelow.

<Evaluation by Digital copier GP-55 and Analog copier NP-9800 (Tables 3 and 4)>

The image resolution was evaluated as follows. An original image was prepared so as to comprise 12 types of resolution images including different number of thin lines per mm, i.e., 2.8, 3.2, 3.6, 4.0, 4.5, 5.0, 5.6, 6.3, 7.1, 8.0, 9.0 and 10.0 lines/mm, respectively, each type including 5 thin lines spaced regularly so as to have a line width and a spacing which were equal to each other. A copy image was prepared by reproducing the original image under the respective image forming conditions and observed through a magnifying glass, whereby the largest number of lines/mm at which the adjacent lines could be observed clearly separately was taken as a resolution.

Higher number means a higher resolution.

<Evaluation by Laser beam printer LBP-SX (Tables 5 and 6)>

The evaluation was performed in the following manners for the respective items.

(1) Image density

The density of an image formed on an ordinary plain paper for copying machine (75 g/$m^2$) after printing 7000 sheets was evaluated by a MacBeth Reflection Densitometer (available from MacBeth Co.) as a relative density against a density of 0.00 allotted to a printed white background portion.

(2) Fog

Image fog (%) was evaluated as a difference between the whiteness of a white background portion of a printed image and the whiteness of an original transfer paper by measurement with "Reflectometer" (available from Tokyo Denshoku K.K.). A fog value exceeding 4% is practically problematic.

(3) Image quality

Figure 4:
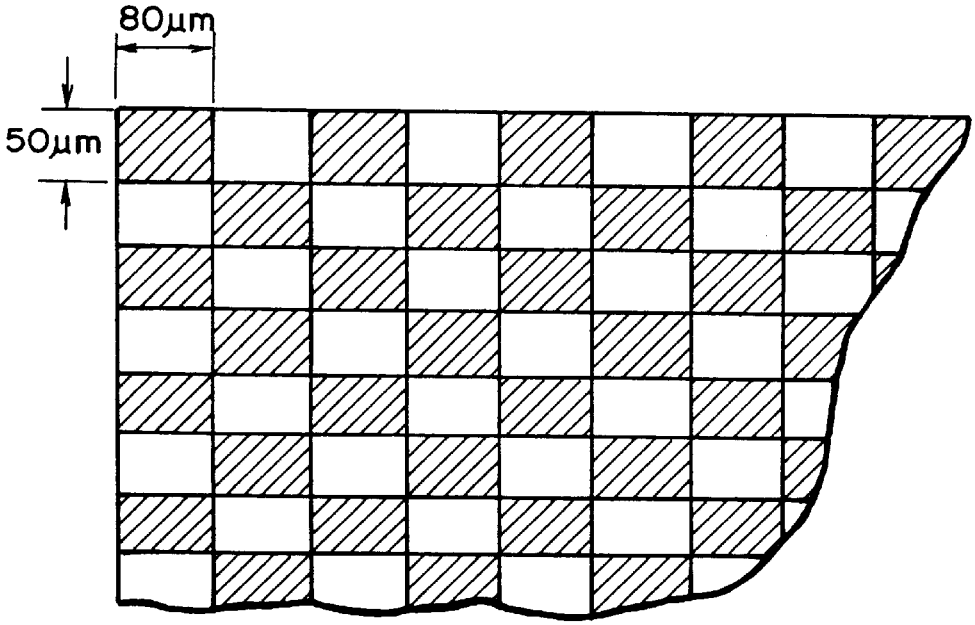
FIG. 4 is a partial illustration of a checker pattern for evaluating the developing performance of a toner.

A checker pattern shown in FIG. 4 was printed out and the dot reproducibility was evaluated by counting the number of lacked dots. The results were evaluated according to the following standards:

◎ (very good): lack of 2-dots or less/100 dots o (good): lack of 3–5 dots/100 dots Δ (fair) lack of 6–10 dots/100 dots x (poor): lack of 11 dots or more/100 dots (4) Fixability A fixed image was rubbed with a soft tissue paper under a load of 50 g/cm$^2$, and the fixability was evaluated by a lowering (%) in image density after the rubbing. The results were evaluated according to the following standards.

◎ (excellent): 5% or below o (good): at least 5% and below 10%

Δ (fair): at least 10% and below 20% x (poor): at least 20%

(5) Anti-offset characteristic

A sample image having an image percentage of about 5% was printed out, and the anti-offset characteristic was evaluated by the degree of soiling on the image after printing of 3000 sheets. The results were evaluated by the following standards.

◎: Very good (non-observable)

o: Good (substantially non-observable)

Δ: Fair x: Poor (6) Sleeve soiling

After the printing test, the state of residual toner sticking onto the developing sleeve surface and the influence thereof on the printed images were evaluated by observation with eyes. The results were evaluated according to the following standards.

◎: Very good (not observable)

o: Good (substantially non-observable)

Δ: Fair (sticking was observed but did not affect the images)

x: Poor (much sticking was observed and resultant in image irregularity)

(7) Film soiling

After the printing test, the state of residual toner sticking onto the surface of the fixing film was evaluated by observation with eyes. The results are evaluated according to the following standards.

◎: Very good (not observable)

o: Good (substantially non-observable)

Δ: Fair x: Poor

TABLE 1

Toner Description and Particle Size

| | Internal prescription | | | | | Particle size | | | |
|---|---|---|---|---|---|---|---|---|---|
| Ex. or Comp. Ex. | Resin | Magnetic iron oxide | Long-chain alkyl compound (or related compound) | Release agent | Azo-type iron complex (or related metal complex) | $D_4$ (μm) | N (%) ≦5 μm | V (%) ≦5 μm | N/V |
| Ex. 1 | A: 100 wt. parts | Dav = 0.15 μm<br>Hc = 115 Oe<br>$\sigma_s$ = 80 emu/g<br>$\sigma_r$ = 11 emu/g<br>90 wt. parts | Formula (1) (alcohol)<br>x = 48, Mn = 440,<br>Mw = 870,<br>Mw/Mn = 1.98,<br>OH value = 66<br>3 wt. parts | None | Complex (1)<br>($NH_4^+$: 90%,<br>$Na^+$, $H^+$: 10%,<br>$S_{MeOH}$ = 0.87 g/100 ml)<br>2 wt. parts | 6.6 | 49.3 | 19.6 | 2.5 |
| Ex. 2 | A: 100 wt. parts | Dav = 0.15 μm<br>Hc = 115 Oe<br>$\sigma_s$ = 80 emu/g<br>$\sigma_r$ = 11 emu/g<br>90 wt. parts | Formula (1) (alcohol)<br>x = 48, Mn = 440,<br>Mw = 870,<br>Mw/Mn = 1.98,<br>OH value = 66<br>3 wt. parts | None | Complex (1)<br>($NH^4$: 80%,<br>$Na^+$, $H^+$, $K^+$: 20%,<br>$S_{MeOH}$ = 0.87 g/100 ml)<br>2 wt. parts | 6.0 | 57.8 | 28.2 | 2.0 |
| Ex. 3 | A: 100 wt. parts | Dav = 0.15 μm<br>Hc = 115 Oe<br>$\sigma_s$ = 80 emu/g<br>$\sigma_r$ = 11 emu/g<br>90 wt. parts | Formula (1) (alcohol)<br>x = 48, Mn = 440,<br>Mw = 870,<br>Mw/Mn = 1.98,<br>OH value = 66<br>3 wt. parts | None | Complex (2)<br>($NH_4^+$: 76%,<br>$Na^+$, $H^+$: 24%,<br>$S_{MeOH}$ = 0.75 g/100 ml)<br>2 wt. parts | 7.2 | 28.2 | 8.1 | 3.5 |
| Ex. 4 | A: 100 wt. parts | Dav = 0.15 μm<br>Hc = 115 Oe<br>$\sigma_s$ = 80 emu/g<br>$\sigma_r$ = 11 emu/g<br>90 wt. parts | Formula (1) (alcohol)<br>x = 48, Mn = 440,<br>Mw = 870,<br>Mw/Mn = 1.98,<br>OH value = 66<br>3 wt. parts | None | Complex (3)<br>($NH_4^+$: 90%,<br>$Na^+$, $H^+$: 10%,<br>$S_{MeOH}$ = 0.71 g/100 ml)<br>2 wt. parts | 7.0 | 36.5 | 11.5 | 3.2 |

TABLE 1-continued

| Toner Description and Particle Size | | | | | | | | | |
|---|---|---|---|---|---|---|---|---|---|
| | Internal prescription | | | | | Particle size | | | |
| Ex. or Comp. Ex. | Resin | Magnetic iron oxide | Long-chain alkyl compound (or related compound) | Release agent | Azo-type iron complex (or related metal complex) | $D_4$ ($\mu$m) | N (%) ≦5 $\mu$m | V (%) ≦5 $\mu$m | N/V |
| Ex. 5 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (1)<br>(alcohol)<br>x = 48, Mn = 440,<br>Mw = 870,<br>Mw/Mn = 1.98,<br>OH value = 66<br>3 wt. parts | None | Complex (4)<br>($NH_4^+$: 98%,<br>$Na^+$, $H^+$: 2%,<br>$S_{MeOH}$ = 0.65 g/100 ml)<br>2 wt. parts | 7.2 | 28.7 | 8.5 | 3.4 |
| Ex. 6 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (1)<br>(alcohol)<br>x = 48, Mn = 440,<br>Mw = 870,<br>Mw/Mn = 1.98,<br>OH value = 66<br>3 wt. parts | None | Complex (5)<br>($NH_4^+$: 90%,<br>$Na^+$, $H^+$: 10%,<br>$S_{MeOH}$ = 0.65 g/100 ml)<br>2 wt. parts | 7.0 | 36.1 | 11.6 | 3.1 |
| Ex. 7 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (1)<br>(alcohol)<br>x = 48, Mn = 440,<br>Mw = 870,<br>Mw/Mn = 1.98,<br>OH value = 66<br>3 wt. parts | None | Complex (6)<br>($NH_4^+$: 90%,<br>$Na^+$, $H^+$: 10%,<br>$S_{MeOH}$ = 0.76 g/100 ml)<br>2 wt. parts | 7.4 | 40.4 | 10.9 | 3.7 |
| Ex. 8 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (1)<br>(alcohol)<br>x = 40, Mn = 350,<br>Mw = 710,<br>Mw/Mn = 2.0,<br>OH value = 80<br>3 wt. parts | None | Same as in Ex. 1 | 6.7 | 52.0 | 21.0 | 2.5 |
| Ex. 9 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (1)<br>(alcohol)<br>x = 35, Mn = 290,<br>Mw = 600,<br>Mw/Mn = 2.07,<br>OH value = 89<br>3 wt. parts | None | Same as in Ex. 1 | 7.2 | 26.7 | 7.7 | 3.5 |
| Ex. 10 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (1)<br>(alcohol)<br>x = 140, Mn = 1100,<br>Mw = 3000,<br>Mw/Mn = 2.73,<br>OH value = 18<br>3 wt. parts | None | Same as in Ex. 1 | 6.9 | 32.0 | 13.5 | 2.4 |
| Ex. 11 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (1)<br>(alcohol)<br>x = 48, Mn = 340,<br>Mw = 1400,<br>Mw/Mn = 4.1,<br>OH value = 65<br>3 wt. parts | None | Same as in Ex. 1 | 7.0 | 38.0 | 14.2 | 2.7 |
| Ex. 12 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Same as in Ex. 1 | H.C. wax<br>*1<br>1 wt. part | Same as in Ex. 1 | 6.8 | 40.0 | 12.5 | 3.2 |
| Ex. 13 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (2)<br>(alcohol)<br>x = 55, z = 2,<br>R = H, Mn = 690,<br>Mw = 15.00,<br>Mw/Mn = 2.17,<br>OH value = 50<br>3 wt. parts | None | Same as in Ex. 1 | 7.0 | 38.0 | 14.2 | 2.7 |
| Ex. 14 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (3)<br>(acid)<br>x = 50, Mn = 350,<br>Mw = 950,<br>Mw/Mn = 2.71,<br>OH value = 60<br>3 wt. parts | None | Same as in Ex. 1 | 6.5 | 40.3 | 16.8 | 2.4 |

TABLE 1-continued

| | Toner Description and Particle Size | | | | | | | | |
|---|---|---|---|---|---|---|---|---|---|
| | Internal prescription | | | | | | | | |
| | | | Long-chain alkyl | | Azo-type iron complex | Particle size | | | |
| Ex. or Comp. Ex. | Resin | Magnetic iron oxide | compound (or related compound) | Release agent | (or related metal complex) | $D_4$ ($\mu$m) | N (%) $\leqq 5$ $\mu$m | V (%) $\leqq 5$ $\mu$m | N/V |
| Ex. 15 | D: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (3)<br>(acid)<br>x = 50, Mn = 350,<br>Mw = 950,<br>Mw/Mn = 2.71,<br>OH value = 60<br>3 wt. parts | None | Same as in Ex. 1 | 5.8 | 59.3 | 31.5 | 1.9 |
| Ex. 16 | F: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (3)<br>(acid)<br>x = 50, Mn = 350,<br>Mw = 950,<br>Mw/Mn = 2.71,<br>OH value = 60<br>3 wt. parts | None | Same as in Ex. 1 | 7.3 | 30.0 | 11.1 | 2.7 |
| Ex. 17 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (3)<br>(acid)<br>x = 50, Mn = 350,<br>Mw = 950,<br>Mw/Mn = 2.71,<br>OH value = 60<br>3 wt. parts | None | Same as in Ex. 1 | 9.2 | 9.2 | 0.8 | 11.5 |
| Ex. 18 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (3)<br>(acid)<br>x = 50, Mn = 350,<br>Mw = 950,<br>Mw/Mn = 2.71,<br>OH value = 60<br>3 wt. parts | None | Same as in Ex. 1 | 6.5 | 30.5 | 14.1 | 2.2 |
| Ex. 19 | A: 100 wt. parts<br>*2<br>F.P. from Ex. 1<br>100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (3)<br>(acid)<br>x = 50, Mn = 350,<br>Mw = 950,<br>Mw/Mn = 2.71,<br>OH value = 60<br>3 wt. parts | None | Same as in Ex. 1 | 7.0 | 35.0 | 13.5 | 2.6 |
| Ex. 20 | D: 100 wt. parts<br>*2<br>F.P. from Ex. 15<br>100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (3)<br>(acid)<br>x = 50, Mn = 350,<br>Mw = 950,<br>Mw/Mn = 2.71,<br>OH value = 60<br>3 wt. parts | None | Same as in Ex. 1 | 6.7 | 38.0 | 16.0 | 2.4 |
| Ex. 21 | F: 100 wt. parts<br>*2<br>F.P. from Ex. 16<br>100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (3)<br>(acid)<br>x = 50, Mn = 350,<br>Mw = 950,<br>Mw/Mn = 2.71,<br>OH value = 60<br>3 wt. parts | None | Same as in Ex. 1 | 7.2 | 28.5 | 9.5 | 3.0 |
| Comp. Ex. 1 | A: 100 wt. parts | Dav = 0.15 $\mu$m<br>Hc = 115 Oe<br>$\sigma_s$ = 80 emu/g<br>$\sigma_r$ = 11 emu/g<br>90 wt. parts | None | None | Chromium<br>*5<br>complex<br>2 wt.<br>parts | 6.2 | 43.0 | 20.5 | 2.1 |
| Comp. Ex. 2 | F: 100 wt. parts<br>*2<br>F.P. from Ex. 16<br>100 wt. parts | Dav = 0.15 $\mu$m<br>Hc = 115 Oe<br>$\sigma_s$ = 80 emu/g<br>$\sigma_r$ = 11 emu/g<br>90 wt. parts | Formula (1)<br>x = 300 Mn =<br>2500,<br>Mw = 6100,<br>Mw/Mn = 2.44,<br>OH value = 1.5<br>3 wt. parts | None | Same as in Ex. 1 | 7.8 | 25.7 | 9.3 | 2.8 |
| Comp. Ex. 3 | A: 100 wt. parts<br>*2<br>F.P. from *2<br>Comp. Ex. 1<br>100 wt. parts | Dav = 0.15 $\mu$m<br>Hc = 115 Oe<br>$\sigma_s$ = 80 emu/g<br>$\sigma_r$ = 11 emu/g<br>90 wt. parts | None | None | *5<br>Chromium<br>complex<br>2 wt.<br>parts | 6.4 | 45.3 | 22.0 | 2.1 |

TABLE 1-continued

| Toner Description and Particle Size | | | | | | | | | |
|---|---|---|---|---|---|---|---|---|---|
| | Internal prescription | | | | | Particle size | | | |
| Ex. or Comp. Ex. | Resin | Magnetic iron oxide | Long-chain alkyl compound (or related compound) | Release agent | Azo-type iron complex (or related metal complex) | $D_4$ (μm) | N (%) ≦5 μm | V (%) ≦5 μm | N/V |
| Comp. Ex. 4 | A: 100 wt. parts | Dav = 0.15 μm<br>Hc = 115 Oe<br>$\sigma_s$ = 80 emu/g<br>$\sigma_r$ = 11 emu/g<br>90 wt. parts | None | None | same as in Ex. 1 | 7.3 | 31.4 | 11.0 | 2.9 |

*1: Hydrocarbon wax (peak molecular weight = 600)
*1: Hydrocarbon wax (peak molecular weight = 600)
*2: Classified fine powder recovered as a by-product after a classification step in a particular Example indicated.
*3: Low molecular weight polyethylene (peak molecular weight = 600) produced as an intermediate product for synthesizing a long-chain salkyl alcohol.
*5: Azo-type chromium complex ("Sipron Black TRH", available from Hodogaya Kagaku K.K.; $S_{MeOH}$ = 0.03 g/100 ml).

TABLE 2

| Localization factors of azo-type iron complex compounds (and related compounds) | | |
|---|---|---|
| Ex. or Comp. Ex. | To classified fine powder $OD_F/OD_M$ | To classified coarse powder $OD_C/OD_M$ |
| Ex. 1 | 1.012 | 0.998 |
| 2 | 1.015 | 0.990 |
| 3 | 1.014 | 0.991 |
| 4 | 1.014 | 0.992 |
| 5 | 1.016 | 0.988 |
| 6 | 1.020 | 0.982 |
| 7 | 1.013 | 0.995 |
| 8 | 1.010 | 0.998 |
| 9 | 1.009 | 0.997 |
| 10 | 1.025 | 0.980 |
| 11 | 1.015 | 0.990 |
| 12 | 1.010 | 0.997 |
| 13 | 1.014 | 0.992 |

TABLE 2-continued

| Localization factors of azo-type iron complex compounds (and related compounds) | | |
|---|---|---|
| Ex. or Comp. Ex. | To classified fine powder $OD_F/OD_M$ | To classified coarse powder $OD_C/OD_M$ |
| 14 | 1.023 | 0.981 |
| 15 | 1.020 | 0.980 |
| 16 | 1.010 | 0.997 |
| 17 | 1.025 | 0.998 |
| 18 | 1.013 | 0.988 |
| 19 | 1.010 | 0.998 |
| 20 | 1.018 | 0.997 |
| 21 | 1.013 | 0.998 |
| Comp. Ex. 1* | 1.085 | 0.902 |
| Comp. Ex. 2 | 1.012 | 0.996 |
| Comp. Ex. 3* | 1.113 | 0.885 |
| Comp. Ex. 4 | 1.012 | 0.998 |

*The contents of aluminum or chromium in classified fine powder, coarse powder and medium powder (toner) were respectively measured by the atomic absorption spectrometry and the ratios among these values were obtained.

TABLE 3

| Evaluation by Digital Copier GP-55 | | | | | | | | | | | | | |
|---|---|---|---|---|---|---|---|---|---|---|---|---|---|
| | N/L (23.5° C., 5% RH) | | | | | | | | H/H (32.5° C., 80% RH) | | | | |
| | Initial | | | | After 5 × $10^4$ sheets | | | | After 8 × $10^4$ sheets*4 | | | | |
| Ex. or Comp. Ex | I.D.*1 | Fog | Gradation*2 | Res.*3 (lines/mm) L/T | I.D. | Fog | Gradation | Res. (lines/mm) L/T | I.D. | Fog | Gradation | Res. (lines/mm) L/T | Sticking*5 |
| Ex. | | | | | | | | | | | | | |
| 1 | 1.52 | ◎ | ◎ | 10.0/10.0 | 1.52 | ◎ | ◎ | 10.0/10.0 | 1.48 | ◎ | ◎ | 10.0/9.0 | ○ |
| 2 | 1.50 | ◎ | ◎ | 10.0/10.0 | 1.50 | ◎ | ◎ | 10.0/10.0 | 1.46 | ◎ | ◎ | 10.0/9.0 | ○ |
| 3 | 1.48 | ○ | ◎ | 9.0/9.0 | 1.48 | ○ | ○ | 9.0/8.0 | 1.40 | ○ | ○ | 8.0/8.0 | ○ |
| 4 | 1.47 | ○ | ◎ | 9.0/9.0 | 1.47 | ○ | ○ | 9.0/8.0 | 1.41 | ○ | ○ | 8.0/8.0 | ○ |
| 5 | 1.48 | ○ | ◎ | 9.0/9.0 | 1.48 | ○ | ○ | 9.0/8.0 | 1.40 | ○ | ○ | 8.0/8.0 | ○ |
| 6 | 1.48 | ○ | ◎ | 9.0/9.0 | 1.48 | ○ | ○ | 9.0/8.0 | 1.40 | ○ | ○ | 8.0/8.0 | ○ |
| 7 | 1.49 | ○ | ◎ | 9.0/9.0 | 1.48 | ○ | ○ | 9.0/8.0 | 1.42 | ○ | ○ | 8.0/8.0 | ○ |
| 8 | 1.50 | ◎ | ◎ | 10.0/10.0 | 1.50 | ◎ | ◎ | 10.0/9.0 | 1.48 | ○ | ◎ | 9.0/9.0 | ○ |
| 9 | 1.50 | ○ | ◎ | 9.0/9.0 | 1.48 | ◎ | ◎ | 9.0/8.0 | 1.46 | ◎ | ◎ | 8.0/7.1 | ○ |

TABLE 3-continued

| Ex. or Comp. Ex | Evaluation by Digital Copier GP-55 | | | | | | | | | | | | |
|---|---|---|---|---|---|---|---|---|---|---|---|---|---|
| | N/L (23.5° C., 5% RH) | | | | | | | | H/H (32.5° C., 80% RH) | | | | |
| | Initial | | | | After 5 × $10^4$ sheets | | | | After 8 × $10^4$ sheets*4 | | | | |
| | I.D.*1 | Fog | Gradation*2 | Res.*3 (lines/mm) L/T | I.D. | Fog | Gradation | Res. (lines/mm) L/T | I.D. | Fog | Gradation | Res. (lines/mm) L/T | Sticking*5 |
| 10 | 1.50 | ○ | ○ | 9.0/9.0 | 1.50 | ○ | ○ | 9.0/9.0 | 1.42 | ○ | ○ | 9.0/8.0 | ○ |
| 11 | 1.50 | ○ | ○ | 10.0/10.0 | 1.50 | ○Δ | ○Δ | 9.0/9.0 | 1.39 | ○ | ○Δ | 8.0/8.0 | ○ |
| 12 | 1.52 | ◎ | ◎ | 10.0/10.0 | 1.52 | ◎ | ◎ | 10.0/10.0 | 1.47 | ◎ | ◎ | 10.0/9.0 | ○ |
| 13 | 1.48 | ◎ | ◎ | 9.0/9.0 | 1.48 | ○ | ○ | 9.0/8.0 | 1.40 | ○ | ○ | 8.0/7.1 | ○ |
| 14 | 1.48 | ○ | ○ | 9.0/9.0 | 1.48 | ○Δ | ○Δ | 8.0/7.1 | 1.40 | ○Δ | ○Δ | 8.0/7.1 | ○ |
| 15 | 1.50 | ◎ | ◎ | 10.0/9.0 | 1.50 | ○ | ○ | 9.0/9.0 | 1.46 | ○ | ○ | 9.9/8.0 | ○ |
| 16 | 1.52 | ◎ | ◎ | 10.0/10.0 | 1.52 | ◎ | ◎ | 10.0/9.0 | 1.48 | ○ | ○ | 9.0/9.0 | ○ |
| 17 | 1.52 | ◎ | ◎ | 10.0/10.0 | 1.42 | ○Δ | ○Δ | 9.0/8.0 | 1.40 | ○ | ○ | 9.0/9.0 | ○ |
| 18 | 1.52 | ◎ | ◎ | 10.0/10.0 | 1.42 | ◎ | ◎ | 9.0/8.0 | 1.46 | ◎ | ◎ | 8.0/7.1 | ○ |
| 19* | 1.52 | ◎ | ◎ | 10.0/10/0 | 1.52 | ◎ | ◎ | 10.0/9.0 | 1.46 | ◎ | ◎ | 9.0/9.0 | ○ |
| 20* | 1.50 | ◎ | ◎ | 10.0/9.0 | 1.47 | ○ | ○ | 9.0/8.0 | 1.42 | ○ | ○ | 8.0/8.0 | ○ |
| 21* | 1.52 | ◎ | ◎ | 10.0/10.0 | 1.50 | ◎ | ◎ | 9.0/9.0 | 1.44 | ○ | ○ | 9.0/8.0 | ○ |
| Comp. Ex. | | | | | | | | | | | | | |
| 1 | 1.40 | ○ | Δ | 9.0/8.0 | 1.30 | Δ | x | 8.0/8.0 | 1.10 | Δ | x | 6.3/5.6 | ○ |
| 2 | 1.40 | ○ | ○ | 8.0/8.0 | 1.35 | ○Δ | Δ | 6.3/5.6 | 1.30 | Δ | Δ | 5.6/5.6 | ○ |
| 3* | 1.33 | Δ | x | 7.1/6.3 | 1.10 | Δ | x | 6.3/6.3 | 1.00 | x | x | Failed | ○ |
| 4 | 1.30 | Δ | x | 7.1/6.3 | 1.15 | x | x | 6.3/5.6 | 1.00 | Δ | x | 3.6/3.6 | Δ |

Notes to Table 3
*1: Image density,
*2: Density gradation reproduction,
*3: Resolution (lines/mm) (longitudinal/transverse),
*4: Cumulative member (after 3 × $10^4$ sheets in high temperature/high humidity),
*5: Melt-sticking of toner onto photosensitive member.

TABLE 4

| Ex. or Comp. Ex. | Evaluation by Analog Copier NP-9800 | | | | | | | | | | | | |
|---|---|---|---|---|---|---|---|---|---|---|---|---|---|
| | N/L (23.5° C., 5% RH) | | | | | | H/H (32.5° C., 80% RH) | | | | | | |
| | Initial | | | After 2 × $10^5$ sheets | | | After 3 × $10^5$ sheets*7 | | | | | | |
| | I.D.*1 | Fog | Res.*3 (lines/mm) L/T | I.D. | Fog | Res. (lines/mm) L/T | I.D. | Fog | Res. (lines/mm) L/T | After 1 M in H/H*8 I.D. | Fog | Storage*6 | Sticking*5 |
| Ex. | | | | | | | | | | | | | |
| 1 | 1.45 | ◎ | 10.0/10.0 | 1.45 | ◎ | 10.0/10.0 | 1.45 | ◎ | 9.0/9.0 | 1.42 | ◎ | ○ | ○ |
| 2 | 1.43 | ◎ | 10.0/10.0 | 1.43 | ◎ | 10.0/10.0 | 1.42 | ◎ | 9.0/9.0 | 1.40 | ◎ | ○ | ○ |
| 3 | 1.40 | ◎ | 9.0/9.0 | 1.40 | ◎ | 9.0/8.0 | 1.39 | ○ | 8.0/8.0 | 1.36 | ○ | ○ | ○ |
| 4 | 1.42 | ◎ | 9.0/9.0 | 1.40 | ◎ | 9.0/8.0 | 1.40 | ○ | 8.0/8.0 | 1.37 | ○ | ○ | ○ |
| 5 | 1.41 | ◎ | 9.0/9.0 | 1.40 | ◎ | 8.0/8.0 | 1.39 | ○ | 8.0/7.1 | 1.36 | ○ | ○ | ○ |
| 6 | 1.44 | ◎ | 8.0/8.0 | 1.42 | ◎ | 8.0/8.0 | 1.40 | ○ | 8.0/7.1 | 1.37 | ○ | ○ | ○ |
| 7 | 1.42 | ◎ | 9.0/8.0 | 1.41 | ◎ | 8.0/8.0 | 1.40 | ○ | 8.0/7.1 | 1.37 | ○ | ○ | ○ |
| 8 | 1.44 | ◎ | 10.0/10.0 | 1.44 | ◎ | 10.0/9.0 | 1.42 | ○ | 9.0/8.0 | 1.40 | ○ | ○ | ○ |
| 9 | 1.42 | ◎ | 10.0/10.0 | 1.43 | ◎ | 9.0/9.0 | 1.43 | ◎ | 8.0/7.1 | 1.41 | ○ | ○ | ○ |
| 10 | 1.45 | ◎ | 10.0/10.0 | 1.43 | ◎ | 9.0/9.0 | 1.42 | ○ | 9.0/9.0 | 1.38 | ○ | ○ | ○ |
| 11 | 1.42 | ◎ | 10.0/10.0 | 1.40 | ○ | 10.0/9.0 | 1.38 | ○ | 8.0/7.1 | 1.35 | ○Δ | ○Δ | ○ |
| 12 | 1.45 | ◎ | 10.0/10.0 | 1.45 | ◎ | 10.0/10.0 | 1.44 | ◎ | 9.0/8.0 | 1.42 | ◎ | ○ | ○ |
| 13 | 1.41 | ◎ | 9.0/9.0 | 1.40 | ◎ | 9.0/8.0 | 1.38 | ◎ | 8.0/8.0 | 1.35 | ◎ | ○ | ○ |
| 14 | 1.43 | ○ | 9.0/9.0 | 1.40 | ○Δ | 9.0/8.0 | 1.38 | ○Δ | 8.0/8.0 | 1.36 | ○Δ | ○ | ○ |
| 15 | 1.45 | ◎ | 10.0/9.0 | 1.44 | ◎ | 10.0/9.0 | 1.41 | ◎ | 9.0/8.0 | 1.40 | ○ | ○ | ○ |
| 16 | 1.44 | ◎ | 10.0/10.0 | 1.43 | ◎ | 10.0/10.0 | 1.42 | ◎ | 9.0/8.0 | 1.40 | ◎ | ○ | ○ |
| 17 | 1.44 | ○ | 9.0/9.0 | 1.37 | ○Δ | 8.0/7.1 | 1.40 | ○Δ | 8.0/7.1 | 1.35 | ○Δ | ○ | ○ |
| 18 | 1.42 | ◎ | 10.0/10.0 | 1.40 | ◎ | 10.0/10.0 | 1.45 | ◎ | 9.0/9.0 | 1.43 | ◎ | ○ | ○ |
| 19* | 1.45 | ◎ | 10.0/10/0 | 1.44 | ◎ | 10.0/10.0 | 1.44 | ◎ | 9.0/8.0 | 1.42 | ◎ | ○ | ○ |
| 20* | 1.44 | ◎ | 10.0/10.0 | 1.44 | ○ | 9.0/9.0 | 1.44 | ◎ | 8.0/8.0 | 1.40 | ◎ | ○ | ○ |
| 21* | 1.43 | ◎ | 10.0/10.0 | 1.43 | ◎ | 10.0/9.0 | 1.43 | • | 9.0/8.0 | 1.40 | ◎ | ○ | ○ |
| Comp. Ex. | | | | | | | | | | | | | |
| 1 | 1.40 | ○ | 9.0/8.0 | 1.35 | Δ | 7.1/7.1 | 1.30 | ○Δ | 6.3/6.3 | 1.25 | Δ | ○ | ○ |

TABLE 4-continued

| Ex. or Comp. Ex. | Evaluation by Analog Copier NP-9800 | | | | | | | | | | | | |
|---|---|---|---|---|---|---|---|---|---|---|---|---|---|
| | N/L (23.5° C., 5% RH) | | | | | | H/H (32.5° C., 80% RH) | | | | | | |
| | Initial | | | After 2 × $10^5$ sheets | | | After 3 × $10^5$ sheets*7 | | | | | | |
| | I.D.*1 | Fog | Res.*3 (lines/mm) L/T | I.D. | Fog | Res. (lines/mm) L/T | I.D. | Fog | Res. (lines/mm) L/T | After 1 M in H/H*8 I.D. | Fog | Storage*6 | Sticking*5 |
| 2 | 1.37 | ○ | 8.0/8.0 | 1.25 | Δ | 6.3/5.6 | 1.15 | Δ | 3.6/3.6 | 1.10 | Δ | ○ | ○ |
| 3* | 1.30 | ○ | 6.3/6.3 | 1.15 | Δ | 5.6/3.6 | 0.97 | x | ** | 0.90 | x | ○ | ○ |
| 4 | 1.28 | Δ | 6.3/5.6 | 1.12 | X | 3.2/3.2 | 1.10 | x | ** | 0.95 | x | ○ | Δ |

*1, *3, *4, *5Same as in Table 3
*6Storage stability,
*7Cumulative (after 1 × $10^5$ sheets in H/H),
*8After standing for 1 month in the H/H environment.
*Recovered fine powder re-utilized.
**Resolution failed.

TABLE 5

| Ex. or Comp. Ex. | Evaluation by LBP-SX | | | | | | | |
|---|---|---|---|---|---|---|---|---|
| | Image density | | | | | | Fog (both sides) | Image quality |
| | N/N | | L/L | H/H | | | L/L | H/H |
| | Initial | Final stage | Final stage | Initial | Fignal stage standing | Final stage | After 5000 sheets | After 6000 sheets |
| Ex. | | | | | | | | |
| 1 | 1.47 | 1.46 | 1.47 | 1.45 | 1.42 | 1.45 | 1.8 | ◎ |
| 2 | 1.46 | 1.45 | 1.47 | 1.44 | 1.43 | 1.45 | 1.8 | ◎ |
| 3 | 1.45 | 1.45 | 1.46 | 1.45 | 1.42 | 1.43 | 1.9 | ○ |
| 4 | 1.46 | 1.45 | 1.46 | 1.44 | 1.43 | 1.44 | 2.1 | ○ |
| 5 | 1.45 | 1.45 | 1.46 | 1.45 | 1.43 | 1.44 | 2.2 | ○ |
| 6 | 1.45 | 1.45 | 1.45 | 1.44 | 1.42 | 1.43 | 2.3 | ○ |
| 7 | 1.46 | 1.45 | 1.45 | 1.44 | 1.42 | 1.43 | 1.9 | ○ |
| 8 | 1.45 | 1.44 | 1.46 | 1.44 | 1.43 | 1.44 | 1.9 | ◎ |
| 9 | 1.46 | 1.45 | 1.45 | 1.44 | 1.43 | 1.44 | 2.0 | ○ |
| 10 | 1.45 | 1.44 | 1.45 | 1.43 | 1.42 | 1.43 | 2.1 | ○ |
| 11 | 1.45 | 1.44 | 1.45 | 1.40 | 1.38 | 1.39 | 3.1 | Δ |
| 12 | 1.45 | 1.44 | 1.44 | 1.43 | 1.42 | 1.42 | 2.5 | ○ |
| 13 | 1.46 | 1.45 | 1.45 | 1.44 | 1.42 | 1.43 | 2.0 | ○ |
| 14 | 1.44 | 1.43 | 1.44 | 1.41 | 1.37 | 1.39 | 3.3 | Δ |
| 15 | 1.46 | 1.46 | 1.47 | 1.46 | 1.43 | 1.44 | 1.8 | ◎ |
| 16 | 1.46 | 1.47 | 1.46 | 1.45 | 1.42 | 1.45 | 1.8 | ◎ |
| 17 | 1.46 | 1.46 | 1.47 | 1.45 | 1.45 | 1.44 | 1.8 | Δ |
| 18 | 1.46 | 1.46 | 1.47 | 1.45 | 1.44 | 1.45 | 1.7 | ◎ |
| 19 | 1.47 | 1.46 | 1.47 | 1.45 | 1.42 | 1.45 | 1.8 | ◎ |
| 20 | 1.46 | 1.45 | 1.47 | 1.44 | 1.42 | 1.43 | 1.8 | ◎ |
| 21 | 1.46 | 1.45 | 1.46 | 1.44 | 1.42 | 1.43 | 1.8 | ◎ |
| Comp. Ex. | | | | | | | | |
| 1 | 1.33 | 1.31 | 1.30 | 1.28 | 1.27 | 1.28 | 2.3 | Δ |
| 2 | 1.35 | 1.33 | 1.32 | 1.30 | 1.28 | 1.28 | 4.6 | x |
| 3 | 1.33 | 1.32 | 1.31 | 1.26 | 1.22 | 1.21 | 4.9 | x |
| 4 | 1.32 | 1.29 | 1.28 | 1.24 | 1.21 | 1.22 | 5.0 | x |

TABLE 6

| | Evaluation of LBP-SX | | | |
|---|---|---|---|---|
| | Fixability | Anti-offset | Sleeve soil | Film soil |
| Ex. 1 | ◎ | ◎ | ◎ | ◎ |
| Ex. 2 | ◎ | ◎ | ◎ | ◎ |

TABLE 6-continued

| | Evaluation of LBP-SX | | | |
|---|---|---|---|---|
| | Fixability | Anti-offset | Sleeve soil | Film soil |
| Ex. 3 | ◎ | ◎ | ○ | ◎ |
| Ex. 4 | ◎ | ◎ | ○ | ◎ |

TABLE 6-continued

| | Evaluation of LBP-SX | | | |
|---|---|---|---|---|
| | Fixability | Anti-offset | Sleeve soil | Film soil |
| Ex. 5 | ◎ | ◎ | ○ | ◎ |
| Ex. 6 | ◎ | ◎ | ○ | ◎ |
| Ex. 7 | ◎ | ◎ | ○ | ◎ |
| Ex. 8 | ◎ | ◎ | ◎ | ◎ |
| Ex. 9 | ◎ | ○ | ○ | ◎ |
| Ex. 10 | ○ | ◎ | ◎ | ◎ |
| Ex. 11 | ◎ | Δ | ○ | ○ |
| Ex. 12 | ◎ | ◎ | ○ | ◎ |
| Ex. 13 | ○ | ◎ | ◎ | ◎ |
| Ex. 14 | ◎ | Δ | Δ | ○ |
| Ex. 15 | ◎ | ◎ | ◎ | ◎ |
| Ex. 16 | ◎ | ◎ | ◎ | ◎ |
| Ex. 17 | Δ | ○◎ | ◎ | |
| Ex. 18 | ◎ | ◎ | ◎ | ◎ |
| Ex. 19 | ◎ | ◎ | ◎ | ◎ |
| Ex. 20 | ◎ | ◎ | ○ | ◎ |
| Ex. 21 | ◎ | ◎ | ○ | ◎ |
| Comp. Ex. 1 | Δ | x | x | Δ |
| Comp. Ex. 2 | x | Δ | ○ | ○ |
| Comp. Ex. 3 | Δ | x | x | Δ |
| Comp. Ex. 4 | Δ | x | x | Δ |

What is claimed is:

1. A toner for developing electrostatic images, comprising:

(a) a binder resin, (b) a long-chain alkyl compound having an acid value of 5–120 mgKOH/g present in amounts from 0.5–20 wt. parts per 100 wt. parts of the binder resin and represented by the following formula (3)

$$CH_3\text{-}(CH_2)_y\text{-}CH_2COOH \quad (3),$$

wherein y denotes an average value in the range of 35–150; and (c) an azo iron complex compound present in amounts from 0.1 to 10 wt parts per 100 wt. parts of the binder resin and represented by the following formula (4):

(4)

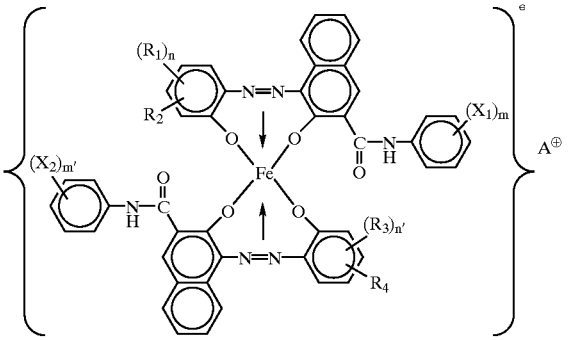

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sulfonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ hydrogen atom or nitro group; and $A^+$ denotes a cation including 75–98 mol. % of ammonium ion and another ion selected from the group consisting of hydrogen ion, sodium ion, potassium ion and mixtures thereof.

2. The toner according to claim 1, wherein said azo iron complex compound has a solubility in methanol of 0.1–8 g/100 ml.

3. The toner according to claim 2, wherein said azo iron complex compound has a solubility in methanol of 0.3–4 g/100 ml.

4. The toner according to claim 3, wherein said azo iron complex compound has a solubility in methanol of 0.4–2 g/100 ml.

5. The toner according to claim 1, wherein said long-chain alkyl compound has a number-average molecular weight Mn of 200–2500, a weight-average molecular weight Mw of 400–5000, and a ratio Mw/Mn of at most 3.

6. The toner according to claim 1, wherein said toner has a weight-average particle size of 4.0–10 μm and contain toner particles of 5 μm or smaller in terms of % by number (N %) and % by volume (V %) satisfying N/V=−0.5N+k, wherein k is a number of 3–12.

7. The toner according to claim 6, wherein said toner has a weight-average particle size of 4.5–9 μm and contains toner particles of 5 μm or smaller in terms of % by number (N %) and % by volume (V %) satisfying N/V −0.05N +k, wherein k is a number of 4–10.

8. An image forming method, comprising:

a charging step of supplying a voltage to a charging means in contact with a member to be charged to charge the member to be charged, a step of forming an electrostatic image on the charged member, a developing step of developing the electrostatic image with a toner to form a toner image on the charged member, a transfer step of transferring the toner image to a transfer-receiving material directly or via an intermediate transfer member, and a fixing step of fixing the toner image onto the transfer-receiving material, wherein said toner comprises:

(a) a binder resin, (b) a long-chain alkyl compound having an acid value of 5–120 mgKOH/g, present in amounts from 0.5–20 wt. parts per 100 wt. parts of the binder resin and represented by the following formula (3):

$$CH_3\text{-}(CH_2)_y\text{-}CH_2COOH \quad (3),$$

wherein y denotes an average value in the range of 35–150; and (c) an azo iron complex compound present in amounts from 0.1 to 10 wt. parts per 100 wt. parts of the binder resin and represented by the following formula (4):

(4)

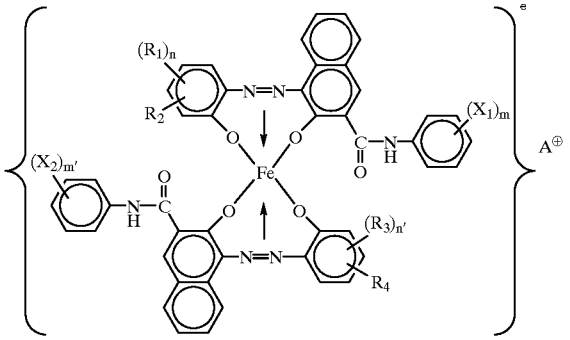

wherein $X_1$ and $X_2$ independently denote hydrogen atom, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sulfonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^+$ denotes a cation including 75–98 mol. % of ammonium ion and another ion selected from the group consisting of hydrogen ion, sodium ion, potassium ion and mixtures thereof.

9. The image forming method according to claim 8, wherein said charging means comprises a charging roller means supplied with a voltage.

10. The image forming method according to claim 8, wherein said charging means comprises a charging brush means supplied with a voltage.

11. The image forming method according to claim 8, wherein said charging means comprises a charging blade means supplied with a voltage.

12. The image forming method according to claim 8, wherein the toner image on the member to be charged is transferred to the transfer-receiving material by a transfer roller means supplied with a voltage.

13. The image forming method according to claim 8, wherein the toner image on the member to be charged is transferred to the transfer-receiving material by a transfer belt means supplied with a voltage.

14. The image forming method according to claim 8, wherein the toner image on the member to be charged is transferred to the intermediate transfer member, and the toner image on the intermediate transfer member is transferred to the transfer-receiving material by a transfer roller means supplied with a voltage.

15. The image forming method according to claim 8, wherein the toner image on the member to be charged is transferred to the intermediate transfer member, and the toner image on the intermediate transfer member is transferred to the transfer-receiving material by a transfer belt means supplied with a voltage.

16. The image forming method according to claim 8, wherein said azo iron complex compound has a solubility in methanol of 0.1–8 g/100 ml.

17. The image forming method according to claim 16 wherein said azo iron complex compound has a solubility in methanol of 0.3–4 g/100 ml.

18. The image forming method according to claim 17, wherein said azo iron complex compound has a solubility in methanol of 0.4–2 g/100 ml.

19. The image forming method according to claim 8, wherein said long-chain alkyl compound has a number-average molecular weight Mn of 200–2500, a weight-average molecular weight Mw of 400–5000, and a ratio Mw/Mn of at most 3.

20. The image forming method according to claim 8, wherein said toner has a weight-average particle size of 4.0–10 μm and contain toner particles of 5 μm or smaller in terms of % by number (N %) and % by volume (V %) satisfying N/V=−0.05N+k, wherein k is a number of 3–12.

21. The image forming method according to claim 20, wherein said toner has a weight-average particle size of 4.5–9 μm and contain toner particles of 5 μm or smaller in terms of % by number (N %) and % by volume (V %) satisfying N/V=−0.05N+k, wherein k is a number of 4–10.

22. A process-cartridge, comprising at least a developing means and a photosensitive member, the developing means and the photosensitive member being integrated into a cartridge which is detachably mountable to a main body of an image forming apparatus, wherein the developing means contains a toner, and the toner comprises:

(a) a binder resin, (b) a long-chain alkyl compound having an acid value of 5–120 mgKOH/g, present in amounts from 0.5–20 wt. parts per 100 wt. parts of the binder resin and represented by the following formula (3):

$$CH_3\text{-}(CH_2)_y\text{-}CH_2COOH \quad (3),$$

wherein y denotes an average value in the range of 35–150; and (c) an azo iron complex compound present in amounts from 0.1 to 10 wt. parts per 100 wt. parts of the binder resin and represented by the following formula (4):

(4)

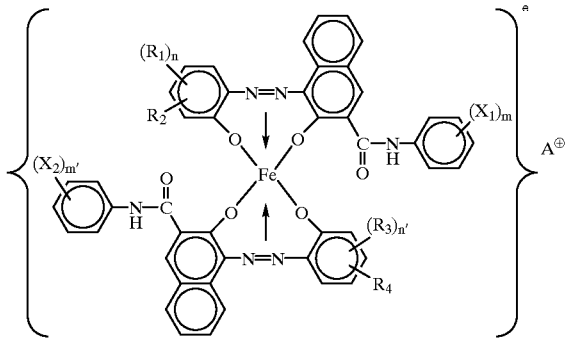

wherein $X_1$ and $X_2$ independently denote hydrogen atoms, lower alkyl group, lower alkoxy group, nitro group or halogen atom; m and m' denote an integer of 1–3; $R_1$ and $R_3$ independently denote hydrogen atom, $C_{1-18}$ alkyl or alkenyl, sulfonamide, mesyl, sulfonic acid group, carboxy ester group, hydroxy, $C_{1-18}$ alkoxy, acetylamino, benzoylamino or halogen atom; n and n' denote an integer of 1–3; $R_2$ and $R_4$ denote hydrogen atom or nitro group; and $A^+$ denotes a cation including 78–98 mol. % of ammonium ion and another ion selected from the group consisting of hydrogen ion, sodium ion, potassium ion and mixtures thereof.

23. The process cartridge according to claim 22, wherein said photosensitive member comprises a photosensitive drum.

24. The process cartridge according to claim 22, wherein a contact charging means is disposed in contact with the photosensitive drum.

25. The process cartridge according to claim 24, wherein the contact charging means comprises a charging roller.

26. The process cartridge according to claim 24, wherein the contact charging means comprises a charging brush.

27. The process cartridge according to claim 24, wherein the contact charging means comprises a charging blade.

28. The process cartridge according to claim 22, wherein a cleaning means is disposed in contact with the photosensitive member.

29. The process cartridge according to claim 28, wherein said cleaning means comprises a cleaning blade.

30. The process cartridge according to claim 22, wherein said azo iron complex compound has a solubility in methanol of 0.1–8 g/100 ml.

31. The process cartridge according to claim 30, wherein said azo iron complex compound has a solubility in methanol of 0.3–4 g/100 ml.

32. The process cartridge according to claim 31, wherein said azo iron complex compound has a solubility in methanol of 0.4–2 g/100 ml.

33. The process cartridge according to claim 22, wherein said long-chain alkyl compound has a number-average molecular weight Mn of 200–2500, a weight-average molecular weight Mw of 400–5000, and a ratio Mw/Mn of at most 3.

34. The process cartridge according to claim 22, wherein said toner has a weight-average particle size of 4.0–10 $\mu$m and contain toner particles of 5 $\mu$m or smaller in terms of % by number (N %) and % by:volume (V %) satisfying $N/V=-0.05N+k$, wherein k is a number of 3–12.

35. The process cartridge according to claim 34, wherein said toner has a weight-average particle size of 4.5–9 $\mu$m and contain toner particles of 5 $\mu$m or smaller in terms of % by number (N %) and % by volume (V %) satisfying $N/V -0.05N+k$, wherein k is a number of 4–10.

* * * * *

UNITED STATES PATENT AND TRADEMARK OFFICE

CERTIFICATE OF CORRECTION

PATENT NO. : 6,365,314 B1
DATED : April 2, 2002
INVENTOR(S) : Koichi Tomiyama et al.

It is certified that error appears in the above-identified patent and that said Letters Patent is hereby corrected as shown below:

Title page,
Item [57], ABSTRACT,
Line 1, "images," should read -- images --; and
Line 11, "COOH (3)," should read -- COOH (3), --.

Column 3,
Line 35, "(i.e.,so-called" should read -- (i.e., so-called --.

Column 5,
Line 32, "$A_+$" should read -- $A^+$ --; and
Line 34, "the-group" should read -- the group --.

Column 8,
Line 20, "g 100 ml." should read -- g/100 ml. --.

Column 19,
Line 20, "$\mu$-unsaturated" should read -- β-unsaturated --; and
Line 52, "polyester, polyester," should read -- polyester, --.

Column 20,
Line 24, "(or)" should read -- (σr) --;
Line 62, "ethylene-" should be deleted; and
Line 63, "biscaprylamide," should be deleted.

Column 22,
Line 57, "Example" should read -- Examples --.

Column 23,
Line 53, "Other-examples" should read -- Other examples --.

Column 29,
Line 58, "a,potential" should read -- a potential --.

Column 33,
Table 1, "OH value=60" should read -- Acid value=60 --.

UNITED STATES PATENT AND TRADEMARK OFFICE

CERTIFICATE OF CORRECTION

PATENT NO. : 6,365,314 B1
DATED : April 2, 2002
INVENTOR(S) : Koichi Tomiyama et al.

It is certified that error appears in the above-identified patent and that said Letters Patent is hereby corrected as shown below:

Column 34,
Table 1, "7.0 38.0 14.2 2.7" should read -- 7.5 35.0 11.7 3.1 --.

Column 37,
Table 1, "*1: Hydrocarbon wax (peak molecular weight = 600)" (second occurrence) should be deleted.

Column 39,
Table 3, "10.0/10/0" should read -- 10.0/10.0 --.

Column 40,
Table 4, "•" should read -- ⊙ --.

Column 43,
Line 40, "10 wt" should read -- 10 wt. --.

Column 45,
Line 60, "claim 16" should read -- claim 16, --.

Column 48,
Line 10, "by:volume" should read -- by volume --.

Signed and Sealed this

Ninth Day of July, 2002

*Attest:*

*Attesting Officer*

JAMES E. ROGAN
*Director of the United States Patent and Trademark Office*